US007611221B2

(12) United States Patent
Kusakari et al.

(10) Patent No.: US 7,611,221 B2
(45) Date of Patent: Nov. 3, 2009

(54) LIQUID EJECTION APPARATUS, IMAGE FORMING APPARATUS AND EJECTION DETERMINATION METHOD

(75) Inventors: Tsutomu Kusakari, Kanagawa (JP); Tsutomu Takatsuka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 46 days.

(21) Appl. No.: 12/044,879

(22) Filed: Mar. 7, 2008

(65) Prior Publication Data

US 2008/0211842 A1 Sep. 4, 2008

Related U.S. Application Data

(62) Division of application No. 11/330,121, filed on Jan. 12, 2006, now Pat. No. 7,370,933.

(30) Foreign Application Priority Data

Jan. 14, 2005 (JP) ..... 2005-008143
Jan. 14, 2005 (JP) ..... 2005-008144

(51) Int. Cl.
*B41J 29/393* (2006.01)

(52) U.S. Cl. ..... 347/19

(58) Field of Classification Search ..... 347/1, 347/5, 19, 20, 73–74, 78, 81
See application file for complete search history.

(56) References Cited

U.S. PATENT DOCUMENTS

2003/0090534 A1 5/2003 Valero et al.
2004/0196319 A1 10/2004 Aruga
2005/0122360 A1 6/2005 Sakagami et al.

FOREIGN PATENT DOCUMENTS

JP 10-296982 A 11/1998
JP 2002-361863 A 12/2002
JP 2003-191453 A 7/2003

*Primary Examiner*—Matthew Luu
*Assistant Examiner*—Justin Seo
(74) *Attorney, Agent, or Firm*—Birch, Stewart, Kolasch and Birch, LLP

(57) ABSTRACT

The liquid ejection apparatus comprises: a liquid ejection head having a plurality of ejection ports which eject droplets of liquid; a light emitting device which emits a determination light beam intersecting with flight paths of the droplets ejected from at least two of the ejection ports to be examined; a light receiving device which receives the determination light beam having passed through the flight paths of the droplets and outputs a determination signal corresponding to an amount of received light; an ejection port selection device which selects the at least two of the ejection ports to be examined so that the at least two of the ejection ports are disposed on a line parallel to an optical axis of the determination light beam, and that a distance between the at least two of the ejection ports along the optical axis of the determination light beam is smaller than a prescribed specific distance; an ejection control device which performs ejection driving to eject the droplets at substantially same time from the at least two ejection ports selected by the ejection port selection device; and an ejection state judgment device which judges droplet ejection state of the at least two ejection ports according to the determination signal outputted by the light receiving device when the droplets ejected due to the ejection driving performed by the ejection control device pass through the determination light beam.

2 Claims, 26 Drawing Sheets

SIDE VIEW OF OPTICAL AXIS

CROSS-SECTION OF OPTICAL AXIS

LIQUID EJECTION APPARATUS, IMAGE FORMING APPARATUS AND EJECTION DETERMINATION METHOD

This is application is a Divisional of application Ser. No. 11/330,121, filed Jan. 12, 2006 now U.S. Pat. No. 7,370,933, and for which priority is claimed under 35 U.S.C. § 120; and this application claims priority of Application No. 2005-008143 filed in Japan on Jan. 14, 2005 and Application No. 2005-008144 filed in Japan on Jan. 14, 2005, under 35 U.S.C. § 119; the entire contents of all are hereby incorporated by reference.

BACKGROUND OF THE INVENTION

1. Field of the Invention

The present invention relates to a liquid ejection apparatus, an image forming apparatus, and an ejection determination method, and more particularly to a liquid ejection apparatus, an image forming apparatus, and an ejection determination method that are suitable for detecting ejection errors in an inkjet head in which a plurality of droplet ejection apertures (nozzles) are arranged two-dimensionally.

2. Description of the Related Art

An inkjet recording apparatus forms images on a recording medium by ejecting ink from nozzles while moving a recording head (also called a print head) in which a plurality of nozzles are arranged and a recording medium relatively with respect to each other. In an apparatus of this kind, caused by increase in the viscosity of the ink, infiltration of air bubbles into the ink, or the like, ejection errors may occur, namely, the ink may cease to be ejected from the nozzles, or the amount of the ejected ink (the size of the dot deposited on the recording medium) and the flight direction of the ejected ink (the position of the dot deposited on the recording medium) may become defective.

In view of these problems, a method is known for determining loss of ink or ejection errors by irradiating light, such as laser light, onto droplets of the ink ejected from a recording head to determine variations in the amount of the light obstructed by the droplets (see Japanese Patent Application Publication Nos. 2003-191453 and 2002-361863).

In Japanese Patent Application Publication No. 2003-191453, since the ejection timing of a nozzle group with respect to the ejection of other nozzle groups is staggered within the range the ejection cycle, then positional adjustment between the optical axis and the nozzles is simplified, thereby improving the determination speed.

On the other hand, in Japanese Patent Application Publication No. 2002-361863, bending of the tail of the droplet (bending of the flight direction) is evaluated by determining the timing and duration at which droplets pass through a light beam of a laser detector, or by examining one nozzle from a plurality of directions by means of a plurality of laser determination systems. When a tail bending is detected, the tail bending is corrected by changing the drive waveform.

However, in the technology disclosed in Japanese Patent Application Publication No. 2003-191453, the timings at which droplets are placed in a determination light beam are controlled by time division, and it is impossible to place a plurality of droplets in the light beam simultaneously. It is hence necessary to perform ejection from a plurality of nozzles at timings staggered from each other, and it then needs a long duration to complete the determination of the ejected droplets in respect of all of the nozzles.

Furthermore, in the technology disclosed in Japanese Patent Application Publication No. 2002-361863, the determination is performed by focusing on the passage duration of a droplet passing through a determination light beam, and the determination is only possible if the amount of bending of the flight direction is relatively large. In other words, although it is possible to detect the tail bending which indicates an extreme directional abnormality with respect to normal ejection, it is considered difficult to determine cases where the amount of bending is small, and hence determination accuracy is not good.

SUMMARY OF THE INVENTION

The present invention has been contrived in view of the foregoing circumstances, an object thereof being to provide a liquid ejection apparatus, an image forming apparatus, and an ejection determination method that can determine a plurality of droplets of liquid ejected from a plurality of droplet ejection ports at substantially the same time, so that the determination duration can be shortened while the determination accuracy can be improved.

In order to attain the aforementioned object, the present invention is directed to a liquid ejection apparatus, comprising: a liquid ejection head having a plurality of ejection ports which eject droplets of liquid; a light emitting device which emits a determination light beam intersecting with flight paths of the droplets ejected from at least two of the ejection ports to be examined; a light receiving device which receives the determination light beam having passed through the flight paths of the droplets and outputs a determination signal corresponding to an amount of received light; an ejection port selection device which selects the at least two of the ejection ports to be examined so that the at least two of the ejection ports are disposed on a line parallel to an optical axis of the determination light beam, and that a distance between the at least two of the ejection ports along the optical axis of the determination light beam is smaller than a prescribed specific distance; an ejection control device which performs ejection driving to eject the droplets at substantially same time from the at least two ejection ports selected by the ejection port selection device; and an ejection state judgment device which judges droplet ejection state of the at least two ejection ports according to the determination signal outputted by the light receiving device when the droplets ejected due to the ejection driving performed by the ejection control device pass through the determination light beam.

According to the present invention, the light emitting device and the light receiving device are provided for optically determining ejected droplets, and at least two ejection ports having a distance therebetween that is shorter than the prescribed specific distance in the direction of the optical axis of the determination light beam are selected as object under examination for simultaneous determination, from the ejection ports situated on the line parallel to the optical axis of the determination light.

If the plurality of droplets to be ejected at substantially the same time from the at least two ejection ports having the above-described positional relationship have actually been ejected normally, the ejected droplets overlap with each other when viewed in a cross-section perpendicularly to the optical axis of the determination light beam, and the distance between the droplets in the direction of the optical axis is shorter than the prescribed specific distance. Thus, the droplet positioned on the rearward side in the travel direction of the determination light beam is in the shadow region of the droplet positioned on the forward side, and the determination light is then hardly irradiated to the rear-positioned droplet.

However, if a flight direction abnormality or a flight speed abnormality has occurred in either of those two droplets ejected at substantially the same time, then the relative positional relationship between the two droplets is disrupted, and the rear-positioned droplet falls outside the aforementioned shadow region. Hence, the determination light is also irradiated to the rear-positioned droplet. Consequently, the determination light is also obstructed by the rear-positioned droplet, and the amount of the light received by the light receiving device then varies according to the number of the droplets present in the determination light beam. In other words, if there has been a flight direction abnormality or a flight speed abnormality in one of the droplets ejected at substantially the same time, then a greater amount of the light is obstructed in comparison with a normal case, and hence the determination signal outputted from the light receiving device varies by a greater amount. Therefore, it is possible to judge whether or not the ejection has been normally performed from the ejection ports under the examination, in other words, whether or not a flight direction abnormality or a flight speed abnormality has occurred, according to the variation in the determination signal.

According to the present invention, since it is possible to determine the ejection state simultaneously with respect to a plurality of ejection ports, then the duration required for determination can be shortened, and the throughput can be improved. Moreover, the determination light can be irradiated to the rear-positioned droplet even if there is only a slight flight direction abnormality or a slight flight speed abnormality, and it is possible to achieve highly accurate determination.

The two or more ejection ports to be examined may be selected from a row which is arranged one-dimensionally, or may be selected from the same row (nozzle row) in a two-dimensional arrangement, or may be selected from different rows (a plurality of nozzle rows).

In the present invention, the term "ejected at substantially the same time" includes a case in which the application timings (drive timing) of the drive signals for driving the pressure generating devices which generate ejection pressure (for example, the actuators or heat generating elements) are simultaneous with each other but the actual ejection timings of the droplets are not strictly simultaneous with each other.

Preferably, the prescribed specific distance is a bending distance of diffracted light of the determination light beam which bends to a rear side of the droplet obstructing the determination light beam.

When the diameter of the droplet is D and the wavelength of the determination light is $\lambda$, the angle $\theta$ of the diffraction is approximately equal to $\lambda/D$ under the condition of $D>\lambda$, and the bending distance L of the diffracted light is expressed as $L=D/(2\times\tan\theta)$. If the distance between the droplets (e.g., the distance between the centers of the droplets, and more preferably the distance between the center of the forward-positioned droplet and the surface of the rear-positioned droplet at the side near to the forward-positioned droplet) is shorter than the bending distance L, then the rear-positioned droplet is inside the shadow region of the forward-position droplet.

Preferably, the liquid ejection apparatus further comprises a determination light movement device which moves the determination light beam with respect to the liquid ejection head.

According to the present invention, since the determination light is moved by the determination light movement device, the ejection determination can be performed for a desired ejection port. In particular, the determination can be performed for all the ejection ports by scanning throughout the entire region of the ejection port groups arranged two-dimensionally with the determination light.

The determination light movement device includes the necessary composition of a movement mechanism for moving all or a portion of the optical members forming the optical system and the light emitting device, a drive source for the movement mechanism and a drive control device, and the like. Moreover, it is sufficient that the determination light is relatively movable with respect to the liquid ejection head, and there are various movement modes such as a parallel movement, a rotational movement, or a combination thereof.

Preferably, the ejection state judgment device is provided with a plurality of judgment threshold values corresponding to a number of the ejection ports selected to be examined and driven to eject the droplets at substantially the same time, and judges a presence of an abnormality in at least one of a flight direction and a flight speed of the droplets ejected from the ejection ports to be examined according to the plurality of judgment threshold values and the determination signal outputted from the light receiving device.

According to the present invention, the determination signal varies according to the number of the droplets obstructing the determination light. Therefore, by establishing the plurality of judgment threshold values for different levels corresponding to the number of the droplets ejected at substantially the same time, it is possible to judge the number of ejection ports corresponding to flight direction abnormality (or flight speed abnormality) among the plurality of ejection ports to be examined.

In the case in which the ejected droplets are simultaneously determined for the plurality of ejection ports and an ejection abnormality is detected in this determination operation, it is preferable that the abnormal ejection port is identified in a second ejection determination operation, by narrowing down the object under the examination to one ejection port or to a smaller number of ejection ports than the number examined in the first determination operation, or by changing the combination of ejection ports which eject the droplets at substantially the same time.

Preferably, the liquid ejection apparatus further comprises: a restoration device which performs restoration operation to restore ejection performance of the liquid ejection head; and a restoration control device which controls the restoration operation performed by the restoration device according to the droplet ejection state judged by the ejection state judgment device.

It is preferable that a restoration operation is carried out by the restoration device, when a presence of the ejection port having a flight abnormality is confirmed by the ejection state judgment device. A restoration operation may be a preliminary ejection, or an operation of suctioning the liquid inside the liquid ejection head, or the like. Thereby, the ejection defect is corrected and satisfactory ejection is made possible.

The present invention also provides an image forming apparatus to attain the aforementioned object. More specifically, the present invention is also directed to an image forming apparatus comprising the above-described liquid ejection apparatus, which forms an image on a recording medium by means of the droplets ejected from the ejection ports.

A compositional embodiment of a liquid ejection head in the image forming apparatus according to the present invention is a full line type inkjet head having a nozzle row in which a plurality of nozzles (ejection ports) are arranged through a length corresponding to the full width of the recording medium.

In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type inkjet head is usually disposed in a direction that is perpendicular to the relative feed direction (relative conveyance direction) of the ejection receiving medium, but a mode may also be adopted in which the inkjet head is disposed following an oblique direction that forms a prescribed angle with respect to the direction perpendicular to the conveyance direction.

Furthermore, when forming color images, it is possible to provide full line type recording heads respectively for inks (recording liquids) of a plurality of colors, and it is also possible to eject inks of a plurality of colors from a single recording head.

The recording medium is a medium (referred to as an ejection receiving medium, a printing medium, an image formation medium, a recorded medium, an image receiving medium, or the like) on which an image is recorded by means of liquid ejected from the liquid ejection head (the recording head), and includes various types of media, irrespective of material and shape, such as continuous paper, cut paper, seal paper, resin sheets such as sheets used for overhead projectors (OHP), film, cloth, a printed circuit board on which a wiring pattern or the like is formed by a liquid ejection head, an intermediate transfer medium.

The conveying device for causing the recording medium and the liquid ejection head to move relatively to each other may be of a mode where the ejection receiving medium is conveyed with respect to a stationary (fixed) head, a mode where a head is moved with respect to a stationary ejection receiving medium, or a mode where both the head and the ejection receiving medium are moved.

The present invention also provides an ejection determination method to attain the aforementioned object. More specifically, the present invention is also directed to a method of determining ejection state of a liquid ejection head having a plurality of ejection ports which eject droplets of liquid, the method comprising the steps of: providing a light emitting device which emits a determination light beam intersecting with flight paths of the droplets ejected from at least two of the ejection ports to be examined, and a light receiving device which receives the determination light beam having passed through the flight paths of the droplets and outputs a determination signal corresponding to an amount of received light; selecting the at least two of the ejection ports to be examined so that the at least two of the ejection ports are disposed on a line parallel to an optical axis of the determination light beam, and that a distance between the at least two of the ejection ports along the optical axis of the determination light beam is smaller than a prescribed specific distance; performing ejection driving to eject the droplets at substantially same time from the at least two ejection ports selected in the selecting step; and judging droplet ejection state of the at least two ejection ports according to the determination signal outputted by the light receiving device when the droplets ejected due to the ejection driving pass through the determination light beam.

In order to attain the aforementioned object, the present invention is also directed to a liquid ejection apparatus, comprising: a liquid ejection head having a plurality of ejection ports which eject droplets of liquid; a light emitting device which emits a determination light beam intersecting with flight paths of the droplets ejected from at least two of the ejection ports to be examined; a light receiving device which receives the determination light beam having passed through the flight paths of the droplets and outputs a determination signal corresponding to an amount of received light; an ejection port selection device which selects the at least two of the ejection ports to be examined so that a distance between the at least two of the ejection ports along the optical axis of the determination light beam is larger than a prescribed specific distance; an ejection control device which performs ejection driving to eject the droplets at substantially same time from the at least two ejection ports selected by the ejection port selection device; and an ejection state judgment device which judges droplet ejection state of the at least two ejection ports according to the determination signal outputted by the light receiving device when the droplets ejected due to the ejection driving performed by the ejection control device pass through the determination light beam.

According to the present invention, the light emitting device and the light receiving device are provided for optically determining ejected droplets, and at least two ejection ports having a distance therebetween that is greater than the prescribed specific distance in the direction of the optical axis of the determination light are selected as object under examination for simultaneous determination. There is a possibility that the droplets ejected at substantially the same time from the at least two ejection ports having this positional relationship may overlap with each other when viewed in cross-section perpendicularly to the optical axis of the determination light; however, the distance between the droplets in the direction of the optical axis is greater than the prescribed specific distance. Therefore, the determination light is bent by a diffraction effect and the light is also irradiated to the rear-positioned droplet. Consequently, since the determination light is also obstructed by the rear-positioned droplet, the amount of the light received by the light receiving device varies according to the number of the droplets present in the determination light beam. In other words, since the determination signal from the light receiving device varies according to the number of droplets ejected at substantially the same time, it is possible to judge whether or not the ejection has been performed normally through the ejection ports to be examined according to the determination signal, and it is also possible to identify the number of the ejection ports which have normally ejected the droplets (or conversely, the number of ejection ports having ejection abnormality).

According to the present invention, since it is possible to carry out ejection determination simultaneously with respect to a plurality of ejection ports, then the duration required for determination can be shortened, and the throughput can be improved. Moreover, the ejection ports to be examined are selected according to the condition that the distance in the direction of the optical axis between the droplets is greater than the prescribed specific distance, so that the light is also irradiated to the rear-positioned droplet among the droplets ejected at substantially the same time. Hence, the determination errors can be prevented, and it is possible to achieve highly accurate determination. Furthermore, when performing the aforementioned determination operation in order to determine loss of the liquid, the ejection driving is performed simultaneously in a plurality of ejection ports, and therefore, it is possible to improve determination sensitivity and accuracy.

In the present invention, the arrangement direction of the at least two ejection ports to be examined is not necessarily parallel to the optical axis of the determination light. However, determination errors are liable to occur in the case where the ejection ports are arranged in a direction parallel to the optical axis due to the light failing to reach the rear-positioned droplet if the distance between the ejection ports is less then the prescribed specific distance. Therefore, it is effective to select the at least two ejection ports to be examined which are situated on a line parallel to the optical axis and which satisfy the condition having the distance between the ejection ports in the direction of the optical axis that is greater than the prescribed specific distance.

Preferably, the prescribed specific distance is a bending distance of diffracted light of the determination light beam which bends to a rear side of the droplet obstructing the determination light beam.

When the diameter of the droplet is D and the wavelength of the determination light is $\lambda$, the angle $\theta$ of the diffraction is approximately equal to $\lambda/D$ under the condition of $D>\lambda$, and the bending distance L of the diffracted light is expressed as $L=D/(2\times\tan\theta)$. If the distance between the droplets (more preferably the distance between the surfaces of the droplets) is larger than the bending distance L, then it is possible to simultaneously determine a plurality of droplets.

Preferably, the liquid ejection apparatus further comprises a determination light movement device which moves the determination light beam with respect to the liquid ejection head.

According to the present invention, since the determination light is moved by the determination light movement device, the ejection determination can be performed for a desired ejection port. In particular, the determination can be performed for all the ejection ports by scanning throughout the entire region of the ejection port groups arranged two-dimensionally with the determination light.

The determination light movement device includes the necessary composition of a movement mechanism for moving all or a portion of the optical members forming the optical system and the light emitting device, a drive source for the movement mechanism and a drive control device, and the like. Moreover, it is sufficient that the determination light is relatively movable with respect to the liquid ejection head, and there are various movement modes such as a parallel movement, a rotational movement, or a combination thereof.

Preferably, the ejection state judgment device is provided with a plurality of judgment threshold values corresponding to a number of the ejection ports selected to be examined and driven to eject the droplets at substantially the same time, and judges a number of the ejection ports normally performing ejection among the ejection ports to be examined according to the plurality of judgment threshold values and the determination signal outputted from the light receiving device.

According to the present invention, since the determination signal varies according to the number of the droplets present in the determination light beam, it is possible to judge the number of ejection ports normally ejecting the droplets among the plurality of ejection ports to be examined by establishing the plurality of threshold values of different levels corresponding to the number of ejected droplets.

In the case in which the ejected droplets are simultaneously determined for the plurality of ejection ports and an ejection abnormality is detected in this determination operation, it is preferable that the abnormal ejection port is identified in a second ejection determination operation, by narrowing down the object under the examination to one ejection port or to a smaller number of ejection ports than the number examined in the first determination operation.

Preferably, the liquid ejection apparatus further comprises: a restoration device which performs restoration operation to restore ejection performance of the liquid ejection head; and a restoration control device which controls the restoration operation performed by the restoration device according to the droplet ejection state judged by the ejection state judgment device.

It is preferable that a restoration operation is carried out by the restoration device, when a presence of the ejection port having an ejection failure is confirmed by the ejection state judgment device. A restoration operation may be a preliminary ejection, or an operation of suctioning the liquid inside the liquid ejection head, or the like. Thereby, the ejection defect is corrected and satisfactory ejection is made possible.

In order to attain the aforementioned object, the present invention is also directed to a liquid ejection apparatus, comprising: a liquid ejection head having a plurality of ejection ports which eject droplets of liquid; a light emitting device which emits a determination light beam intersecting with flight paths of the droplets ejected from at least two of the ejection ports to be examined; a light receiving device which receives the determination light beam having passed through the flight paths of the droplets and outputs a determination signal corresponding to an amount of received light; a first ejection port selection device which selects the at least two of the ejection ports to be examined with respect to ejection failure so that a distance between the at least two of the ejection ports selected by the first ejection port selection device along the optical axis of the determination light beam is larger than a prescribed specific distance; a first ejection control device which performs ejection driving to eject the droplets at substantially same time from the at least two ejection ports selected by the first ejection port selection device; a first ejection state judgment device which judges whether or not the droplets are ejected from the at least two ejection ports to be examined with respect to ejection failure according to the determination signal outputted by the light receiving device when the droplets ejected due to the ejection driving performed by the first ejection control device pass through the determination light beam; a second ejection port selection device which selects the at least two of the ejection ports to be examined with respect to flight abnormality so that the at least two of the ejection ports are disposed on a line parallel to the optical axis of the determination light beam, and that a distance between the at least two of the ejection ports selected by the second ejection port selection device along the optical axis of the determination light beam is smaller than the prescribed specific distance; a second ejection control device which performs ejection driving to eject the droplets at substantially same time from the at least two ejection ports selected by the second ejection port selection device; and a second ejection state judgment device which judges a presence of an abnormality in at least one of a flight direction and a flight speed of the droplets ejected from the ejection ports to be examined with respect to flight abnormality according to the determination signal outputted by the light receiving device when the droplets ejected due to the ejection driving performed by the second ejection control device pass through the determination light beam.

According to the present invention, it is possible to detect ejection failure by selecting ejection ports that are separated by a distance larger than the prescribed specific distance as object under examination, and it is also possible to detect flight abnormalities by selecting ejection ports that are separated by a distance smaller than the prescribed specific distance as object under examination.

As described above, it is preferable that the prescribed specific distance is a bending distance of diffracted light of the determination light beam which bends to a rear side of the droplet obstructing the determination light beam.

Furthermore, a mode is also possible in which the above-described compositions are appropriately combined.

In order to attain the aforementioned object, the present invention is also directed to a method of determining ejection state of a liquid ejection head having a plurality of ejection ports which eject droplets of liquid, the method comprising the steps of: providing a light emitting device which emits a determination light beam intersecting with flight paths of the droplets ejected from at least two of the ejection ports to be examined, and a light receiving device which receives the determination light beam having passed through the flight paths of the droplets and outputs a determination signal corresponding to an amount of received light; selecting the at least two of the ejection ports to be examined so that a distance between the at least two of the ejection ports along the optical axis of the determination light beam is larger than a prescribed specific distance; performing ejection driving to eject the droplets at substantially same time from the at least two ejection ports selected in the selecting step; and judging droplet ejection state of the at least two ejection ports according to the determination signal outputted by the light receiving device when the droplets ejected due to the ejection driving pass through the determination light beam.

As described above, according to the present invention, since the ejection can be determined simultaneously with respect to a plurality of ejection ports, then the duration required for determination can be shortened, and productivity can be improved. Moreover, even a slight displacement in the flight direction or disparity in the flight speed can be determined, and hence determination accuracy can be improved. Further, the present invention can also be applied suitably to determination of ejection in a large number of nozzles, or nozzles in a high-density arrangement.

Furthermore, according to the present invention, since the distance in the direction of the optical axis between the plurality of droplets is greater than the prescribed specific distance, and then the ejection ports to be examined are selected according to the condition in which the determination light can be also irradiated to the rear-positioned droplet among the droplets ejected at substantially the same time, then the determination errors can be prevented and the determination accuracy can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 13A is a diagram showing a positional relationship between a cross-section of the determination light beam and an ink droplet when viewed from the photosensor, FIG. 13B is a diagram showing variation in a sensor output waveform of determination signal due to passage of the droplet, and FIG. 13C is a diagram showing a waveform of signal which extracts the variation in the determination signal;

DETAILED DESCRIPTION OF THE PREFERRED EMBODIMENTS

General Configuration of Inkjet Recording Apparatus

Figure 1:
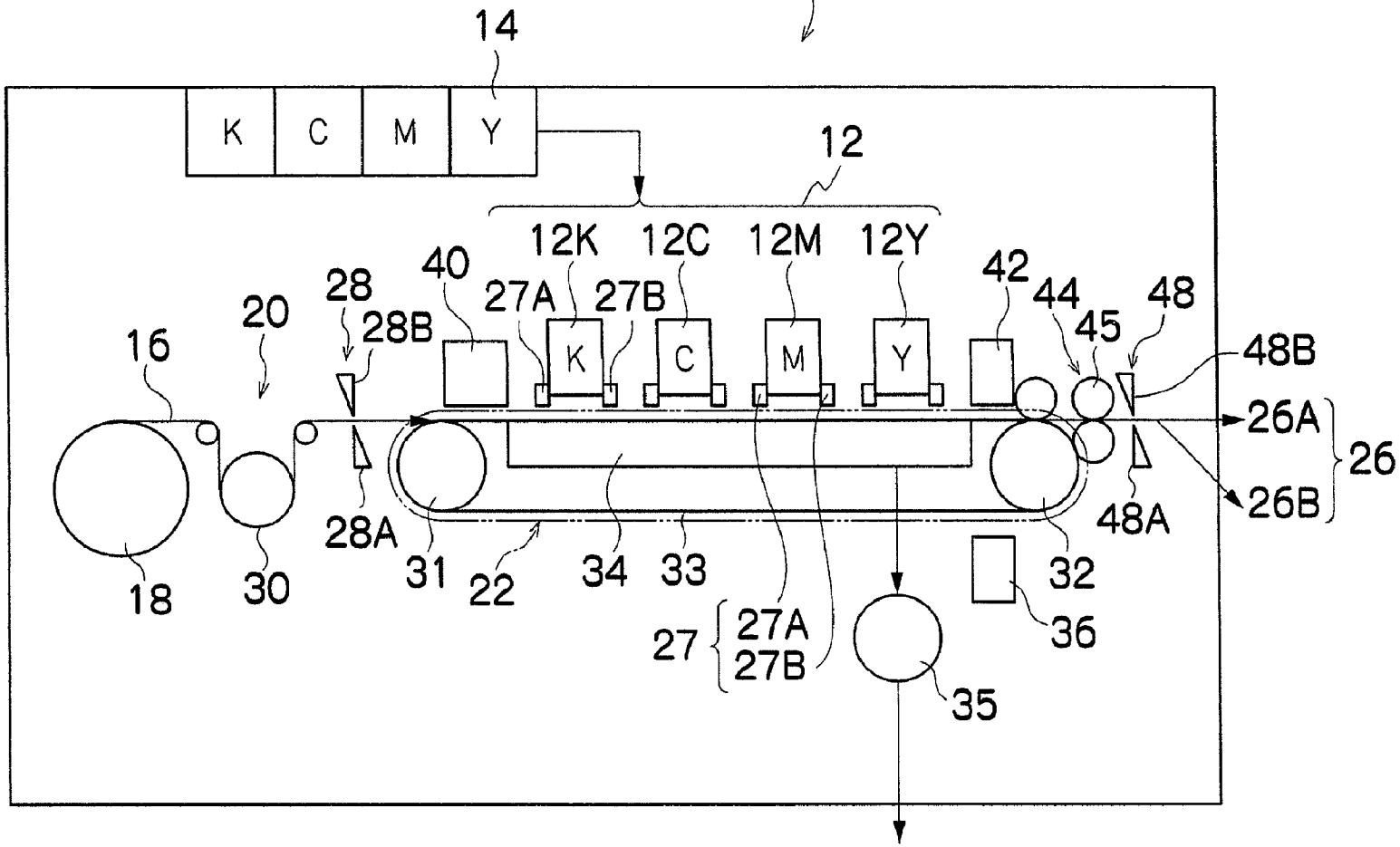
FIG. 1 is a general schematic drawing of an inkjet recording apparatus using a liquid ejection apparatus according to an embodiment of the present invention.

FIG. 1 is a general schematic drawing of an inkjet recording apparatus using a liquid ejection apparatus according to an embodiment of the present invention. As shown in FIG. 1, the inkjet recording apparatus 10 comprises: a printing unit 12 having a plurality of inkjet recording heads (hereinafter, called "print heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16, which forms a recording medium; a decurling unit 20 (corresponding to a conveyance device) for removing curl in the recording paper 16; a suction belt conveyance unit 22 disposed facing the nozzle face (ink droplet ejection face) of the printing unit 12, for conveying the recording paper 16 while keeping the recording paper 16 flat; and a paper output unit 26 for outputting printed recording paper (printed matter) to the exterior. Furthermore, each of the print heads 12K, 12C, 12M and 12Y is provided with an ejection observing device 27 comprising a light source (corresponding to a light generating device) 27A and a photosensor (corresponding to a light receiving device) 27B for optically detecting droplets in flight ejected from the nozzles (ink ejection ports).

The ink storing and loading unit 14 has tanks (ink tanks) for storing the inks of K, C, M and Y to be supplied to the print heads 12K, 12C, 12M, and 12Y, and the ink tanks are connected to the print heads 12K, 12C, 12M, and 12Y by means of channels which are not shown. The ink tank storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium can be used, it is preferable that an information recording medium such as a bar code and a wireless tag containing information about the type of recording medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable. It is also possible to use a belt conveyance device using electrostatic attraction, instead of a belt conveyance device based on attraction by suction.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
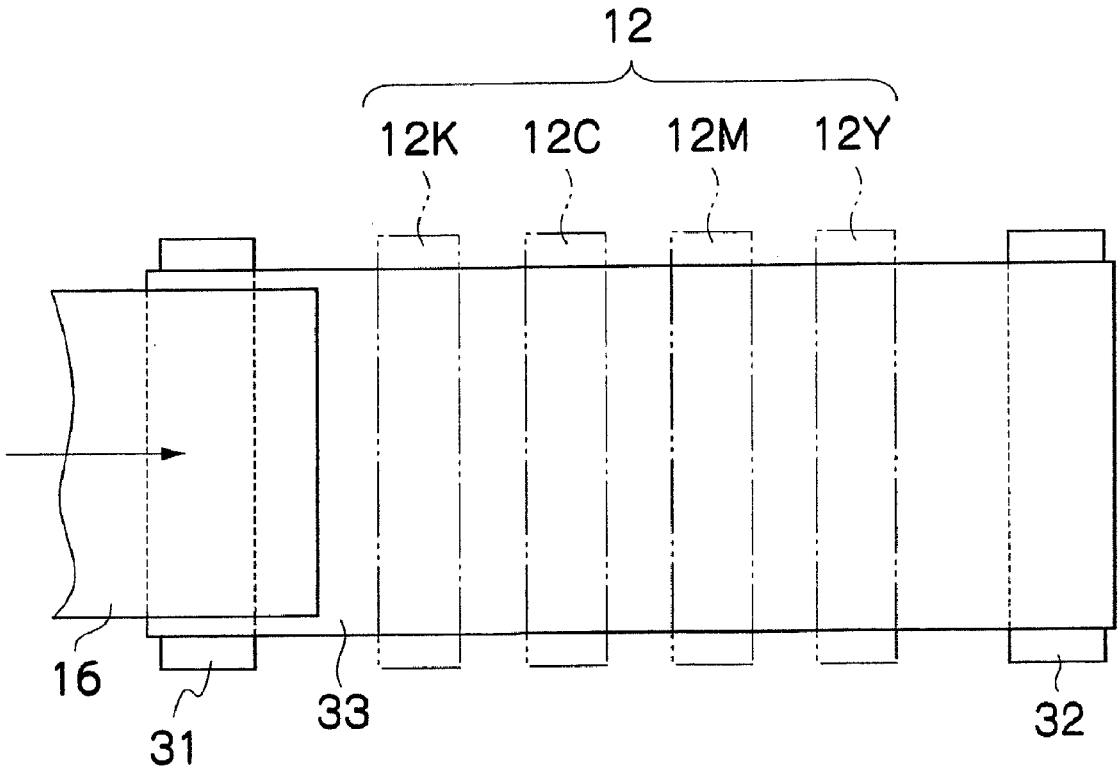
FIG. 2 is a principal plan diagram of the peripheral area of a printing unit in the inkjet recording apparatus shown in FIG. 1.

The print heads 12K, 12C, 12M and 12Y in the printing unit 12 are full line heads having a length corresponding to the maximum width of the recording paper 16 used with the inkjet recording apparatus 10, and each comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in the color order (black (K), cyan (C), magenta (M), and yellow (Y)) from the upstream side in the feed direction of the recording paper 16, and the print heads 12K, 12C, 12M and 12Y are fixed extending in a direction substantially perpendicular to the conveyance direction of the recording paper 16.

A color image can be formed on the recording paper 16 by ejecting inks of different colors from the print heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the print heads of respective colors are arranged.

As shown in FIG. 1, a post-drying unit 42 is disposed following the printing unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Print Head

Next, the structure of a head will be described. The print heads 12K, 12C, 12M and 12Y of the respective ink colors have the same structure, and a reference numeral 50 is hereinafter designated to any of the print heads.

Figure 3:
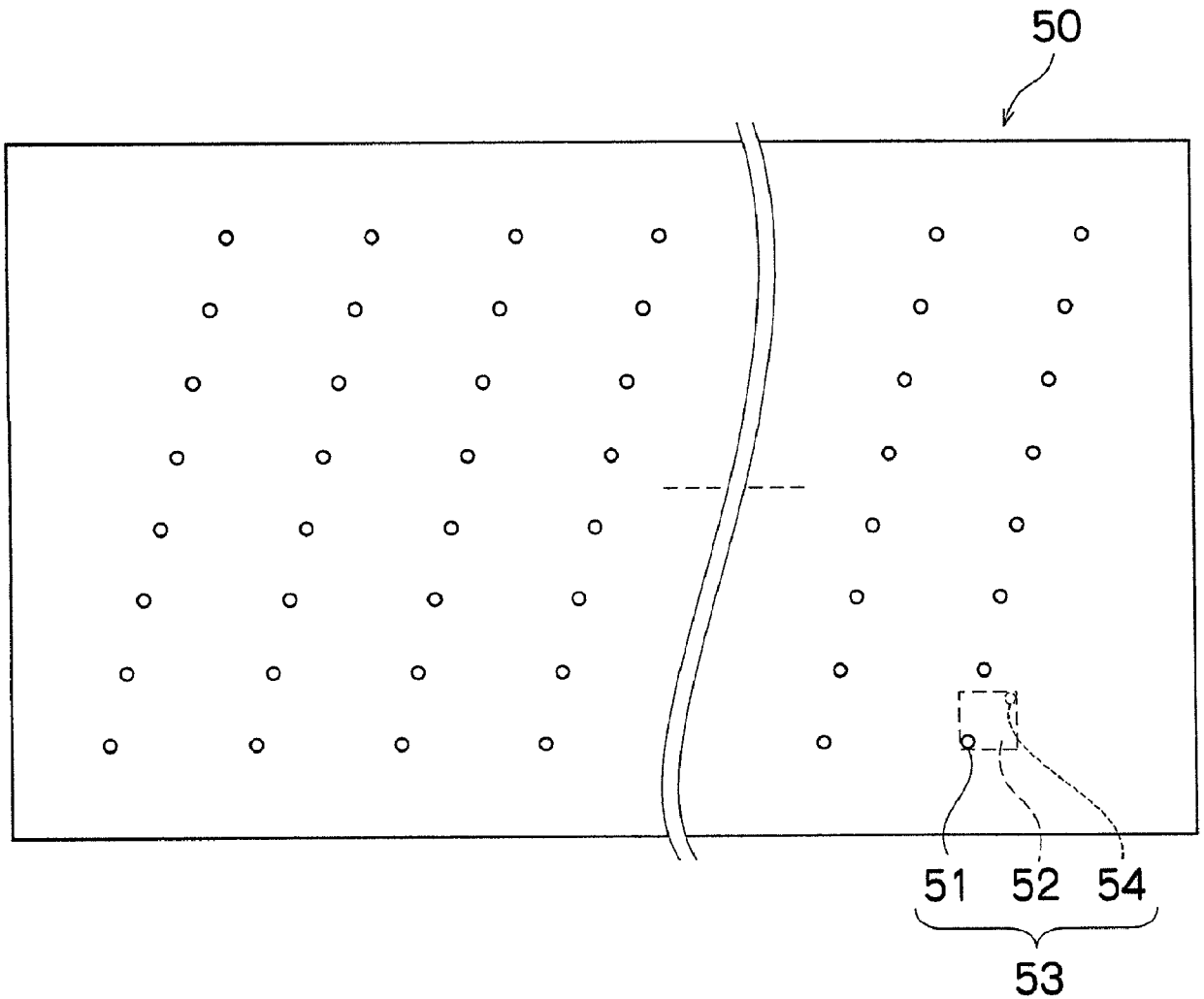
FIG. 3 is a plan diagram of a print head when viewed from the side of ejection surface (nozzle surface)
Figure 4:
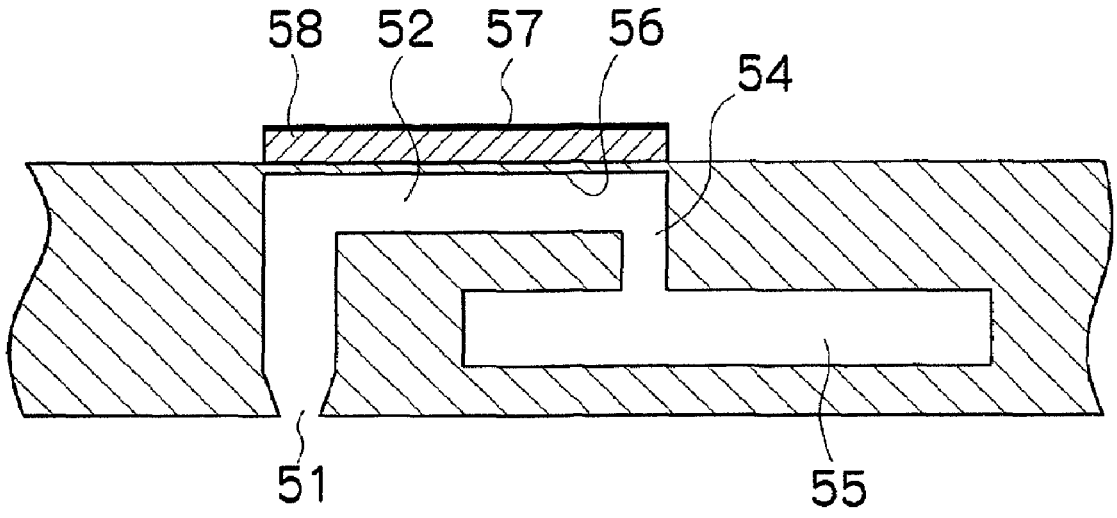
FIG. 4 is a cross-sectional diagram showing a three-dimensional composition of one ejection element in the print head.

FIG. 3 is a diagram of the print head 50 when viewed from the side of the ejection port surface (nozzle surface), and FIG. 4 is a cross-sectional diagram showing a three-dimensional composition of one droplet ejection element (ink chamber unit corresponding to one nozzle 51). In order to achieve a high density of the dot pitch printed onto the surface of the recording paper 16, it is necessary to achieve a high density of the nozzle pitch in the print head 50. As shown in FIG. 3, the print head 50 according to the present embodiment has a structure in which a plurality of ink chamber units (droplet ejection elements) 53, which each include a nozzle 51 as the ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head 50 (the direction perpendicular to the paper conveyance direction) is reduced (high nozzle density is achieved).

As shown by the dotted lines in FIG. 3, the planar shape of the pressure chamber 52 provided corresponding to each nozzle 51 is substantially a square shape, and an outlet port to the nozzle 51 is provided at one of the ends of the diagonal line of the planar shape, while an inlet port (supply port) 54 for supplying ink is provided at the other end thereof. The shape of the pressure chamber 52 is not limited to that of the present embodiment, and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 4, each pressure chamber 52 is connected to a common flow passage 54 via the supply port 55. The common flow channel 55 is connected to an ink tank (not shown in FIG. 4, but indicated by reference numeral 60 in FIG. 7), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate (a diaphragm that also serves as a common electrode) 56 which forms one portion (in FIG. 4, the ceiling) of the pressure chamber 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to use a piezoelectric element using a piezoelectric body, such as lead zirconate titanate, barium titanate, or the like. When the displacement of the actuator 58 returns to its original position after ejecting ink, new ink is supplied to the pressure chamber 52 from the common flow channel 55 via the supply port 54.

Figure 5:
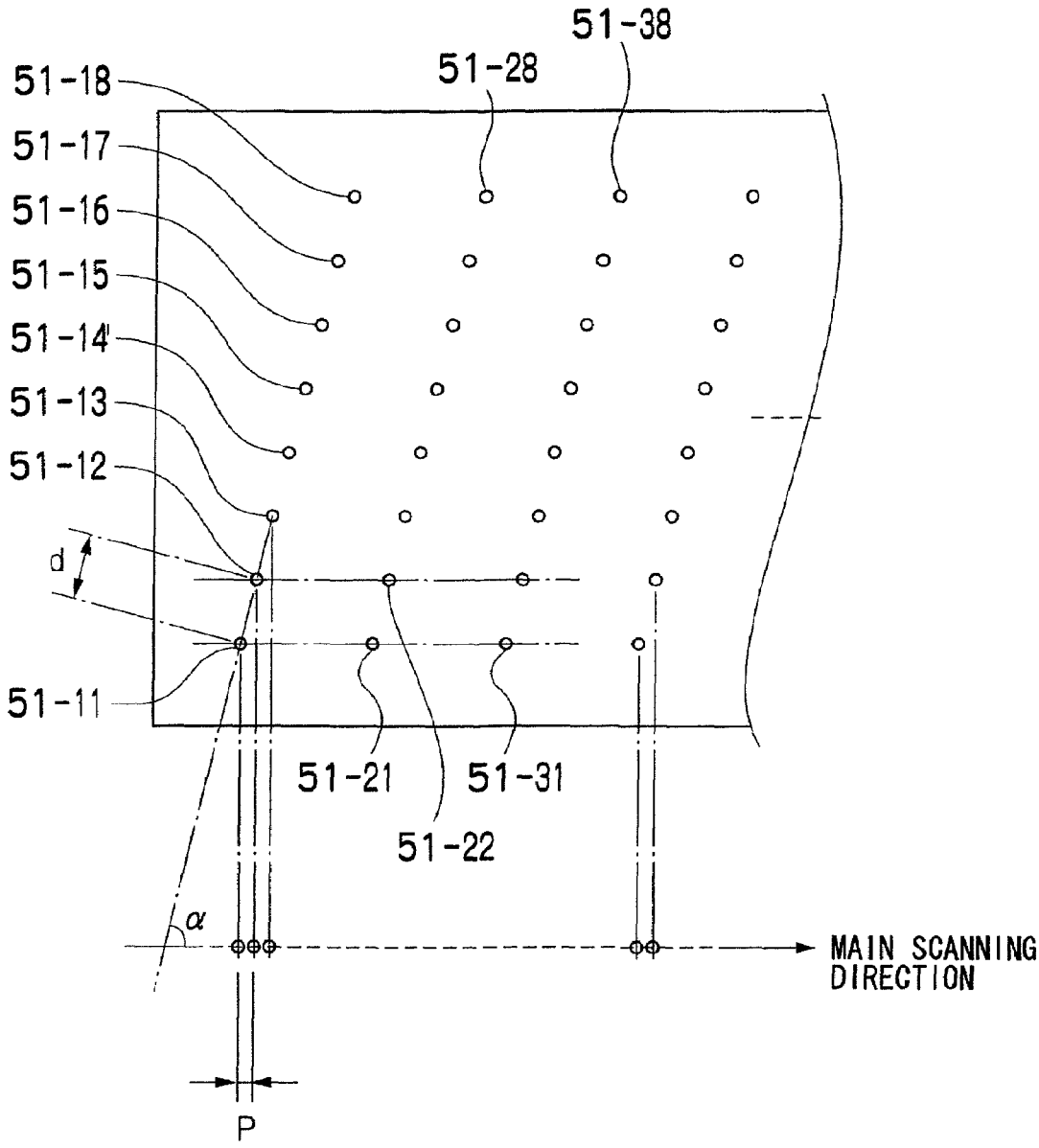
FIG. 5 is an enlarged view showing a nozzle arrangement in the print head shown in FIG. 3.

As shown in FIG. 5, the high-density nozzle head according to the present embodiment is achieved by arranging a plurality of ink chamber units 53 having the above-described structure in a lattice fashion based on a fixed arrangement pattern, in a row direction which corresponds to the main scanning direction, and a column direction which is inclined at a fixed angle of $\alpha$ with respect to the main scanning direction, rather than being perpendicular to the main scanning direction.

More specifically, by adopting a structure in which the nozzles 51 are arranged at a uniform pitch d in line with a direction forming an angle of $\alpha$ with respect to the main scanning direction, the pitch P of the nozzles 51 projected so as to align in the main scanning direction is $d \times \cos \alpha$, and hence the nozzles 51 can be regarded to be equivalent to those arranged linearly at a fixed pitch P along the main scanning direction. With such configuration, it is possible to achieve a nozzle row with a high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording medium 16 by sequentially driving the nozzles 51-11, 51-12, . . . , 51-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction along one line (or the lengthwise direction of a band-shaped region) recorded by main scanning as described above is called the "main scanning direction", and the direction in which the sub-scanning is performed, is called the "sub-scanning direction". In other words, in the present embodiment, the conveyance direction of the recording paper 16 is called the sub-scanning direction and the direction perpendicular to same is called the main scanning direction.

Figure 6:
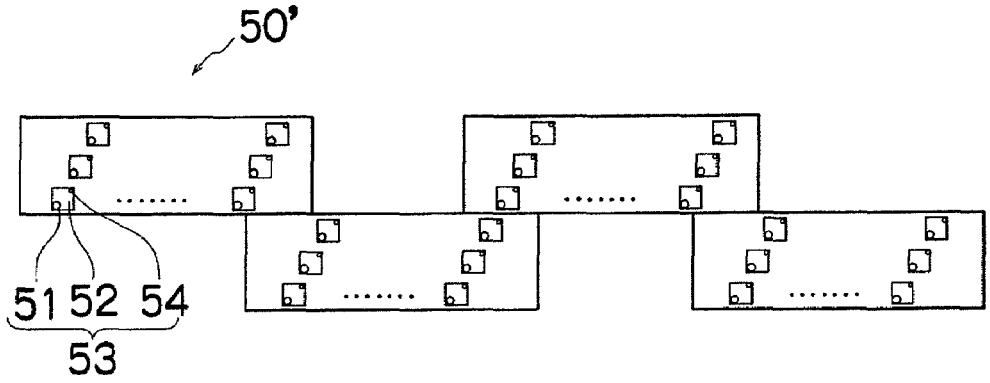
FIG. 6 is a plan diagram showing another example of the print head.

The structure of the print head 50 and the mode of the arrangement of the nozzles are not limited to those shown in FIGS. 3 to 5. For example, as shown in FIG. 6, it is also possible to compose a full line head having nozzle rows of a length corresponding to the full width of the recording paper 16, by joining together, in a staggered matrix arrangement, a number of short head blocks 50', in which a plurality of nozzles 51 are arranged two-dimensionally.

Furthermore, as described in FIG. 4, a method is employed in the present embodiment that an ink droplet is ejected by means of the deformation of the actuator 58, which is typically a piezoelectric element. However, in implementing the present invention, the method used for discharging ink is not limited in particular. Instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 7:
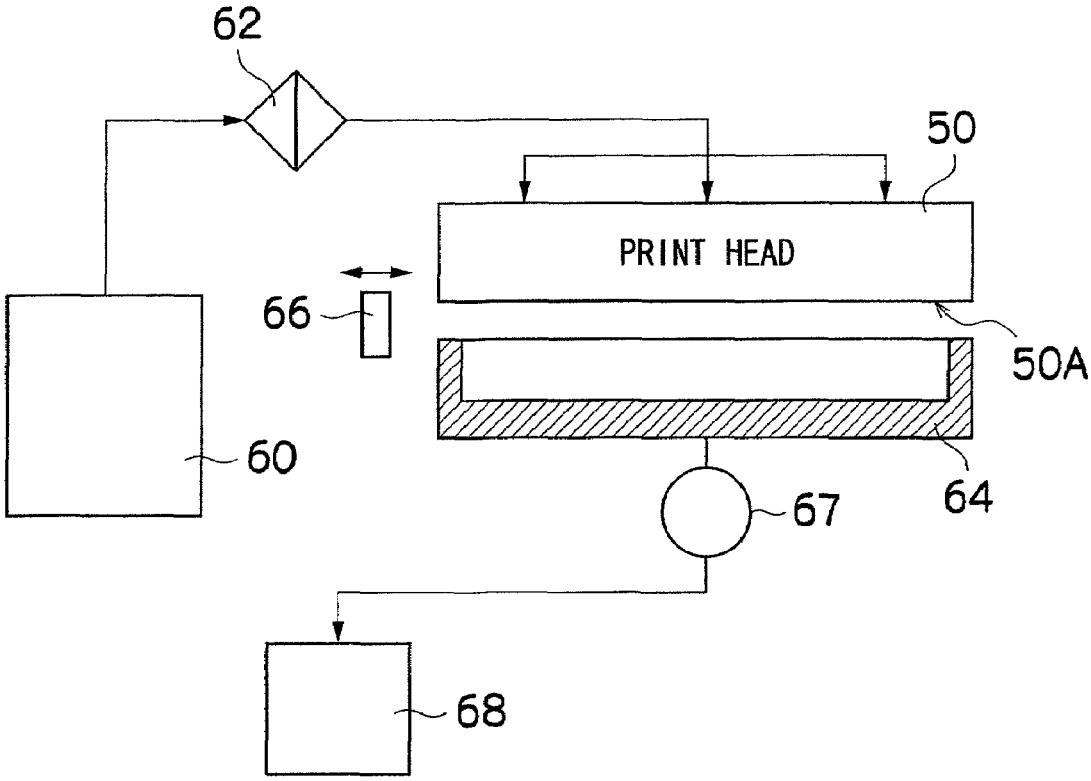
FIG. 7 is a schematic drawing showing composition of an ink supply system in the inkjet recording apparatus.

FIG. 7 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The types of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type depending on the intended application, the cartridge type is suitable, and it is preferable to represent the ink type information with a bar code or the like on the cartridge, and to perform ejection control depending on the ink type. The ink supply tank 60 in FIG. 7 is equivalent to the ink storing and loading unit 14 in FIG. 1.

A filter 62 for removing foreign matters and bubbles is disposed between the ink tank 60 and the print head 50 as shown in FIG. 7. The filter mesh size in the filter 62 is preferably equivalent to or less than the diameter of the nozzle and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoring device) including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the nozzle surface 50A (surface of the nozzle plate) of the print head 50 by means of a blade movement mechanism (not shown). When ink droplets or foreign matter has adhered to the surface of the nozzle plate, the surface of the nozzle plate is wiped by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64 (also used as an ink receptor).

Also, when air bubbles have intermixed in the ink inside the print head 50 (inside the pressure chamber), the cap 64 is placed on the print head 50, the ink inside the pressure chamber (the ink in which bubbles have become intermixed) is removed by suction with a suction pump 67, and the suction-removed ink is sent to a collection tank 68. This suction action entails the suctioning of degraded ink of which viscosity has increased (hardened) also when initially loaded into the print head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (i.e., during a state that the viscosity range of the ink allows the ink ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, when air bubbles have intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when air bubbles have intermixed in the ink inside the nozzle 51 and the pressure chamber 52, ink can no longer be ejected from the nozzle 51 even if the actuator 58 is operated. Furthermore, when the ink viscosity inside the nozzle 51 has increased over a certain level, the ink can no longer be ejected from the nozzle 51 even if the actuator 58 is operated. In those cases, a suctioning device to remove the ink inside the pressure chamber 52 by suction with the suction pump, or the like, is placed on the nozzle face of the print head 50, and the ink in which bubbles have become intermixed or the ink of which viscosity has increased is removed by suction.

Since this suction action is performed with respect to all of the ink in the pressure chambers 52, then the amount of ink consumption is considerable. Therefore, it is preferable that a preliminary ejection is carried out, whenever possible, while the increase in viscosity is still minor. The cap 64 shown in FIG. 7 functions as a suctioning device and it may also function as an ink receptacle for preliminary ejection. The suction operation is also carried out when ink is loaded into the print head 50 for the first time, and when the print head starts to be used after being idle for a long period of time.

Description of Control System

Next, a control system of the inkjet recording apparatus 10 will be described.

Figure 8:
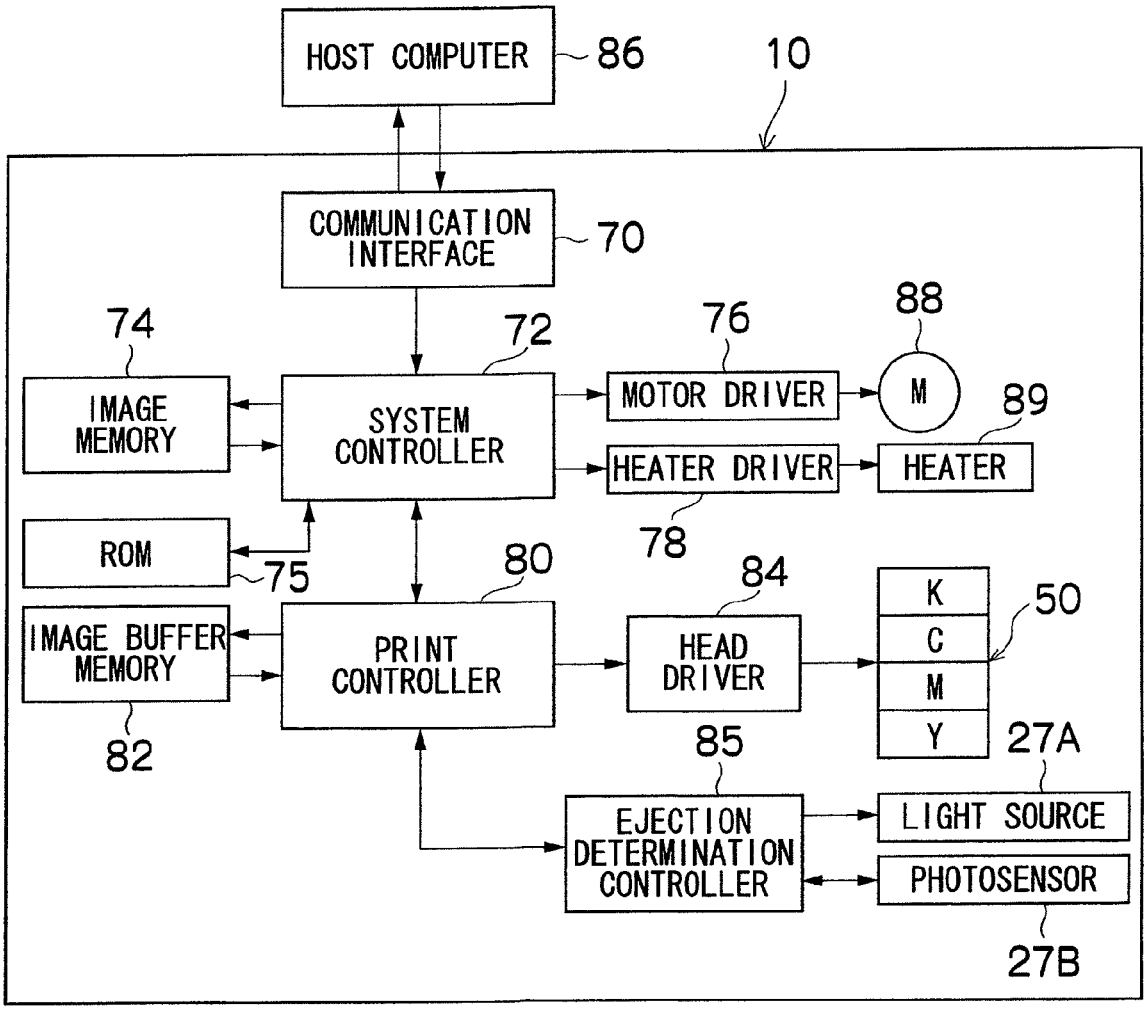
FIG. 8 is a principal block diagram showing a system composition of the inkjet recording apparatus.

FIG. 8 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, an ejection determination controller 85, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used as the image memory.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like. The system controller 72 controls communications with the host computer 86, controls writing and reading to and from the image memory 74 and the ROM 75, and also generates control signals for controlling the motor 88 and heater 89 of the conveyance system.

The program executed by the CPU of the system controller 72 and the various types of data that are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit or the like in accordance with commands from the system controller 72.

The print controller 80 has a signal processing function for performing various tasks, compensations, and other types of processing for generating print control signals on the basis of the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the print heads 50 are controlled via the head driver 84, on the basis of the print data. By this means, prescribed dot size and dot positions can be achieved.

The image buffer memory 82 is provided in the print controller 80, and image data, parameters, and other data are temporarily stored in the image buffer memory 82 when image data is processed in the print controller 80. In FIG. 8, the image buffer memory 82 is depicted as being attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is inputted from an external source via a communications interface 70, and is accumulated in the image memory 74. At this stage, RGB image data is stored in the image memory 74, for example.

In this inkjet recording apparatus 10, an image that appears to have a continuous tonal graduation to the human eye is formed by changing the dot density and the dot size of fine dots created by depositing droplets of the ink (coloring material). Therefore, it is necessary to convert the input digital image into a dot pattern that reproduces the tonal gradations of the image (namely, the light and shade toning of the image) as faithfully as possible. Hence, original image data (RGB data) stored in the image memory 74 is sent to the print controller 80 through the system controller 72, and is converted to the dot data for each ink color by a half-toning technique, such as dithering or error diffusion, in the print controller 80.

More specifically, the print controller 80 performs processing for converting the input RGB image data into dot data for the four colors of K, C, M, and Y. The dot data thus generated by the print controller 80 is stored in the image buffer memory 82.

The head driver 84 outputs drive signals for driving the actuators 58 corresponding to the nozzles 51 of the print head 50, according to the print data supplied by the print controller 80 (i.e., the dot data stored in the image buffer memory 82). A feedback control system for maintaining constant drive conditions in the print heads may be included in the head driver 84.

When the drive signals outputted by the head driver 84 are supplied to the print head 50, the ink is ejected from the corresponding nozzles 51. By controlling ink ejection from the print heads 50 in accordance with the conveyance speed of the recording paper 16, an image is formed on the recording paper 16.

As described above, the ejection volume and the ejection timing of the ink droplets from each nozzle are controlled via the head driver 84, on the basis of the dot data generated by implementing required signal processing in the print controller 80. By this means, desired dot size and dot arrangement can be achieved.

The ejection determination controller 85 comprises a light source control circuit, which controls the switching on and off of the ejection determination light source 27A and the amount of light emitted when switched on, a drive circuit for the photosensor 27B, and a signal processing circuit, which processes the determination signal from the photosensor 27B. The ejection determination controller 85 controls the operations of the light source 27A and the photosensor 27B in accordance with the commands from the print control unit 80, and it supplies the determination results obtained from the photosensor 27B to the print controller 80.

The print controller 80 determines the ejection state of the nozzles 51 (ejection or ejection failure, presence or absence of abnormalities in the flight direction, the flight speed, and the like), according to the determination information obtained via the ejection determination controller 85, and if the print controller 80 detects an abnormal nozzle, then it implements control for performing prescribed countermeasures (a restoring operation, or the like). In other words, the print controller 80 functions as the ejection port selection device, the ejection control device and the ejection state judgment device according to the present invention.

Ejection Determination Method

Figure 9:
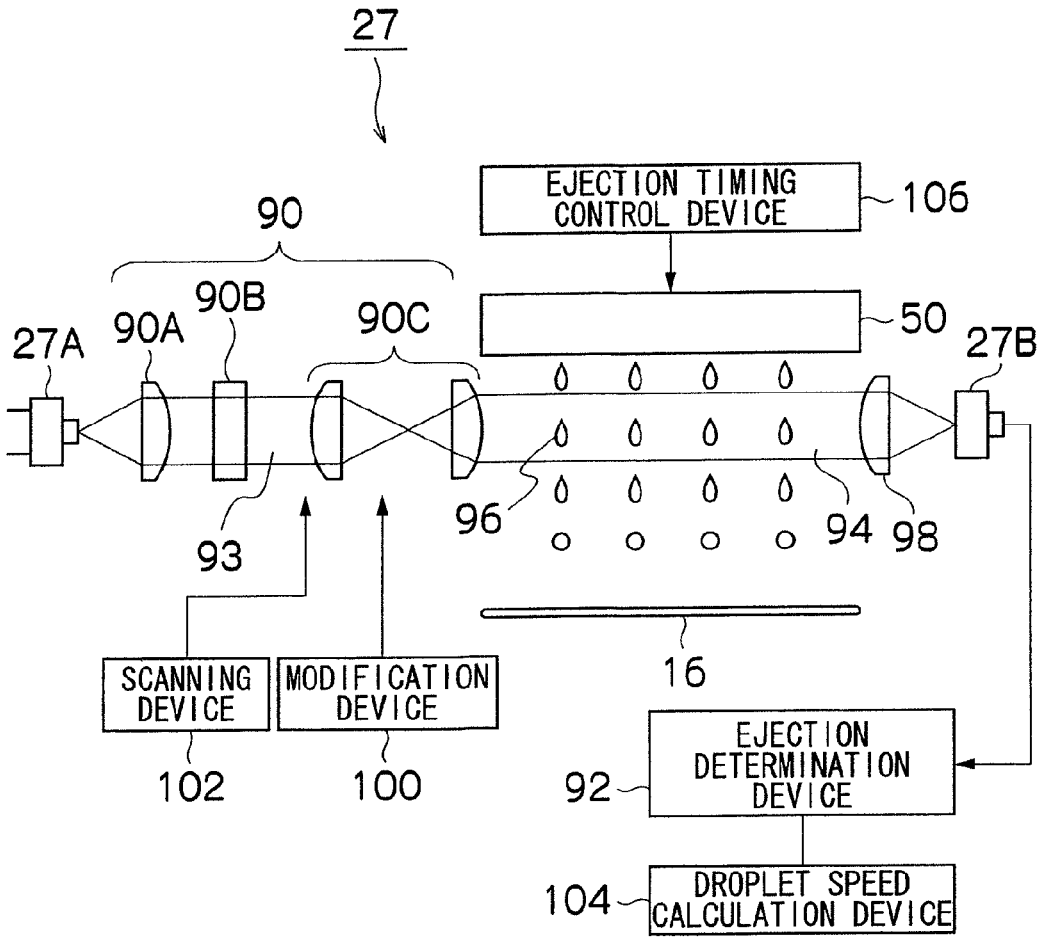
FIG. 9 is a schematic compositional drawing of an ejection observing device, including a partial block diagram.

FIG. 9 is a general schematic drawing of the ejection observing device 27 for determining droplets in flight. As shown in FIG. 9, the ejection observing device 27 comprises the light source 27A such as a laser diode (LD), the photosensor 27B, an optical system 90, which forms the light emitted from the light source 27A into a light beam of a prescribed shape, an ejection determination device 92, which determines the ejection state by receiving a determination signal from the photosensor 27B, and the like.

The light path from the light source 27A to the photosensor 27B is not necessarily a linear composition, and various types of light path configurations may be adopted by using commonly known optical members (light bending devices) such as mirrors and prisms, optical fibers, and the like.

In implementing the present invention, the type of light source 27A is not limited in particular, but it is preferable to use a coherent light source having a relatively narrow waveband, such as a laser diode (LD) and light emitting diode (LED).

The optical system 90 comprises a collimating lens 90A and a cylindrical lens 90B for forming the light from the light source 27A into first parallel light 93 that is substantially parallel light of a first width, and a beam converter 90C for forming the first parallel light 93 into second parallel light 94 that is substantially parallel light of a second beam width different from the first beam width. The beam converter 90C changes the cross-sectional shape of the beam by narrowing the light beam, or by laterally spreading the light beam (in other words, the beam converter 90C alters the vertical beam width and/or the lateral beam width).

The optical system that changes the parallel light into parallel light of the different width, the optical system that switches the widths of the parallel light while changing the width of the parallel light, and the like, are described later.

The second parallel light 94 is formed in the space through which the droplets fly between the nozzle surface 50A of the print head 50 and the recording paper 16, and the direction of the optical axis of the second parallel light 94 is set to be perpendicular to the flight direction of the ink droplets (droplets) 96 ejected from the print head 50.

The second parallel light 94 (hereinafter referred to as the "determination light beam 94") is condensed by a condensing lens 98, so that the light is received by the photosensor 27B at the substantial condensation point of the light. The photosensor 27B is a photoelectric transducer, which outputs an electrical signal corresponding to the amount of received light. The amount of received light varies according to the number of droplets present in the determination light beam 94, and the signal (determination signal) outputted from the photosensor 27B accordingly varies.

The determination signal outputted from the photosensor 27B is inputted to the ejection determination device 92, and then the ejection state of the nozzles 51, such as a presence or absence of the droplet in flight (ejection or ejection failure), a divergence of the flight direction, and a divergent of the flight speed, is determined according to the determination signal. The details of this ejection determination method are described later.

The ejection observing device 27 further comprises: a modification device 100, which modifies the cross-sectional shape of the determination light beam 94; a scanning device 102, which traverses the droplets 96 ejected from the print head 50 with the determination light beam 94; a droplet speed calculation device 104, which calculates the flight speed of the droplets 96 according to the determination signal of the photosensor 27B; and an ejection timing control device 106, which controls the ejection timing at which the droplets 96 are ejected into the determination light beam 94.

The modification device 100 includes members and drive control circuits thereof for changing the optical composition by changing positions and/or the optical characteristics (e.g., index of refraction) of the optical members in the optical system 90. The scanning device 102 (corresponding to the determination light moving device) includes a movement mechanism and motor for moving the light source 27A and all or a portion of the optical system 90. The ejection determination device 92, the droplet speed calculation device 104 and the ejection timing control device 106 are realized by the combination of the blocks shown in FIG. 8, such as the system controller 72, the print controller 80 and the ejection determination controller 85, and perform calculations and control procedures according to prescribed programs, respectively.

Principles of Ejection Determination

Here, the principles of the ejection determination will be described.

Figure 10:
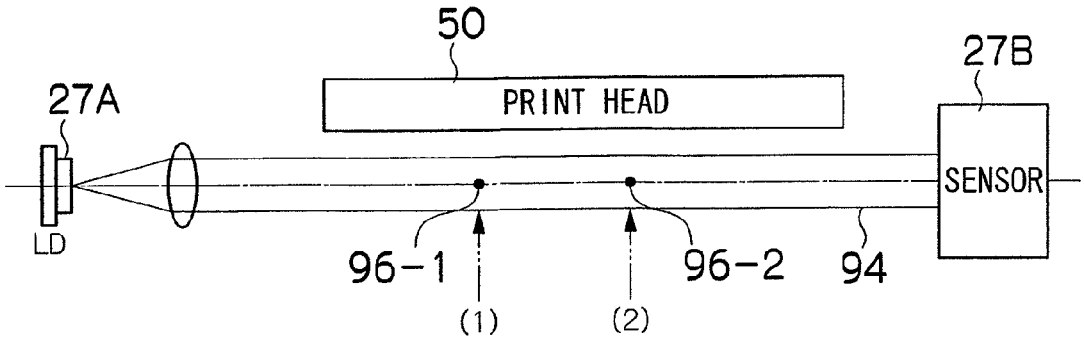
FIG. 10 is a general schematic drawing showing an example in a case of determining droplets of liquid ejected simultaneously from a plurality of nozzles to be examined.

FIG. 10 is a schematic diagram of the determination system. The optical system is formed so that the light from the light source 27A (a laser diode (LD) in the present embodiment) shown in the left-hand side in FIG. 10 is converted into parallel light, which is directed toward the photosensor 27B. In the group of nozzles provided in the print head 50, the selection is performed to select two nozzles disposed in a line parallel to the optical axis of the determination light beam 94 (namely, nozzles (1) and (2) to be examined corresponding to positions (1) and (2) in FIG. 10), and two droplets 96-1 and 96-2 are simultaneously placed into the determination light beam 94 by simultaneously driving the two nozzles. Here, consideration is given to the distance between the two droplets (which is substantially equal to the distance between the two nozzles (1) and (2) along the optical axis) at which it is possible to determine the two droplets.

In general, even if there is an obstacle which obstructs the light traveling linearly, the light bends around the edges of the obstacle to the shadow side by the diffraction phenomenon, and therefore the light is also incident on the rear side region of the obstacle at a certain distance from the obstacle. Although the interference effect produces a light intensity distribution at a short distance from the obstacle, the diffraction effect is under the present discussion while focusing on the amount of light.

Figure 11:
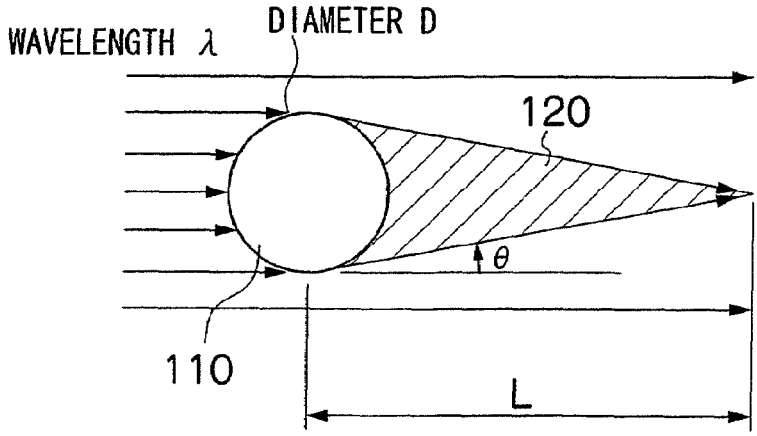
FIG. 11 is a schematic drawing for explaining the bending of light due to a diffraction effect.

FIG. 11 is a schematic drawing showing a situation where a droplet (an obstacle which obstructs the light) is present in the determination light beam. When the parallel light of the wavelength $\lambda$ is irradiated from the left-hand side in FIG. 11 on a droplet 110 of the diameter D, then the light diffraction in an angle $\theta$ occurs due to Fraunhofer diffraction. Consequently, there is a region 120 which is not reached by the light (hereafter referred to as "shadow region 120") behind the droplet 110. The shadow region 120 is substantially of a right circular cone form, and is shown as a substantially triangular region indicated by the oblique shading in FIG. 11.

In the case of $D>\lambda$, the diffraction angle $\theta$ is approximately equal to $\lambda/D$. Then, the distance L between the center of the droplet 110 and the apex of the corresponding shadow region 120 (namely, the bending distance of the diffracted light) is expressed as $L=D/(2\times\tan\theta)$. For example, when the droplet diameter D is 30 μm (14 picoliters in volume) and the wavelength $\lambda$ is 800 nm, then the distance L is 0.56 mm.

The determination light is not liable to reach within the shadow region 120 specified by the distance L, while the determination light does reach the region that is situated further than the specified distance L. Therefore, as in the case of droplets A and C shown in FIG. 12, when the distance in the direction of the optical axis between the two droplets A and C ejected simultaneously is smaller than the specified distance L, then the light hardly reaches the rear-positioned droplet A, and hence it is difficult to detect the droplet A. On the other hand, as in the case of droplets B and C in FIG. 12, when the distance in the direction of the optical axis between the two droplets B and C is greater than the specified distance L, then sufficient light bends around to the rear-positioned droplet B, and hence it is possible to detect the droplet B.

Therefore, when determination of ejection failure (presence or absence of ejection) is performed with respect to a plurality of nozzles, a pair of nozzles that satisfy the condition $Pn>L$ are selected as nozzles to be examined (see FIG. 12), where Pn is the distance between the centers of the two droplets (in other words, the pitch between the centers of the nozzles).

In this way, when ejection failure is determined by simultaneously ejecting a plurality of droplets, the distance (interval) in the direction of the optical axis between the droplets is set to a distance that is greater than a specified value calculated from the size of the droplets and the wavelength of the light emitted from the light source, so that highly accurate determination can be achieved.

Figure 13A:
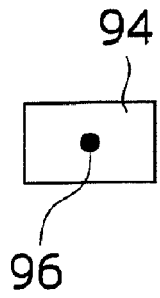
FIGS. 13A to 13C are diagrams for explaining principles of ejection determination.
Figure 13B:
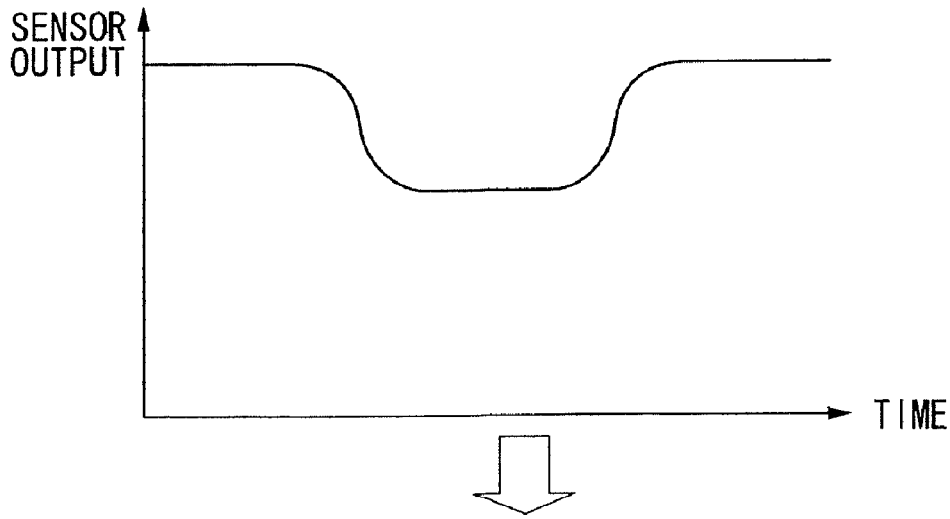

FIG. 13A is a diagram showing the positional relationship between the cross-section of the determination light beam 94 (the cross-section of the received light as viewed from the photosensor 27B), and the droplet 96; FIG. 13B is a sensor output waveform diagram showing variations in a determination signal caused by the passage of the droplet; and FIG. 13C is a waveform diagram showing a signal obtained by extracting variations from the determination signal shown in FIG. 13B (namely, a signal indicating the amount of the variations, hereinafter referred to as "variation extract signal").

Figure 13C:
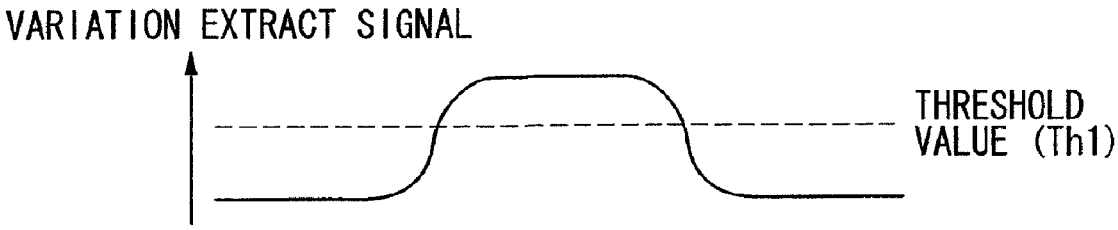

As shown in FIGS. 13A to 13C, when a droplet 96 (one droplet) enters into the determination light beam 94, a portion of the determination light beam 94 is obstructed by this droplet 96, and then the amount of light incident on the photosensor 27B decreases. Accordingly, the output of the photosensor 27B is weakened. When the droplet 96 has finished passing through the determination light beam 94, and no droplet 96 is present in the determination light beam 94, then the output of the photosensor 27B returns to the original reference level.

As shown in FIG. 13C, a threshold value Th1 is previously set for droplet detection, so that it is possible to determine whether any droplet is present in the determination light beam 94 by comparing the variation extract signal of the sensor output with the threshold value (Th1).

Figure 14:
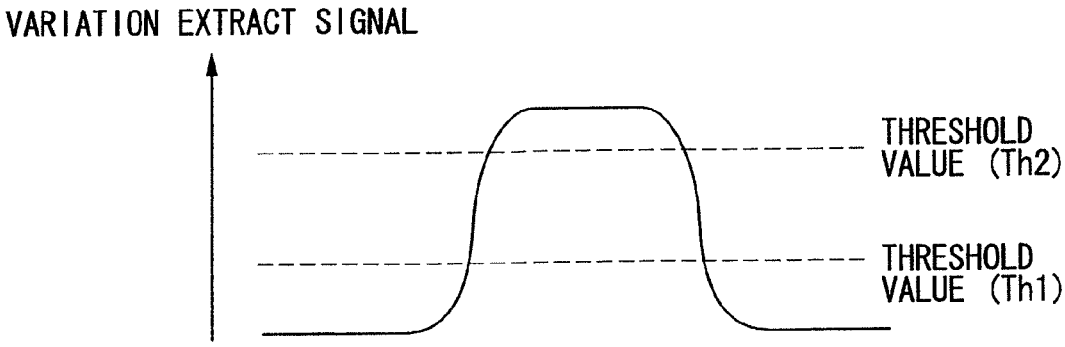
FIG. 14 is a diagram showing an example of the variation extract signal in the sensor output signal when the two ejected droplets are simultaneously determined.
Figure 15:
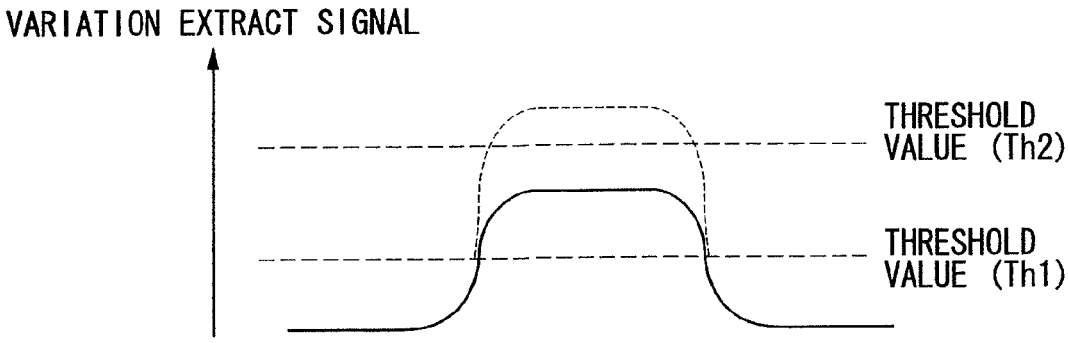
FIG. 15 is a diagram showing another example of the variation extract signal in the sensor output signal when the two ejected droplets are simultaneously determined.

FIGS. 14 and 15 are diagrams showing examples of the variation extract signal of the sensor output obtained when two droplets are simultaneously determined. In FIGS. 14 and 15, the vertical axis represents the amplitude of the signal (for example, the voltage value), and the horizontal axis represents the time.

Figure 12:
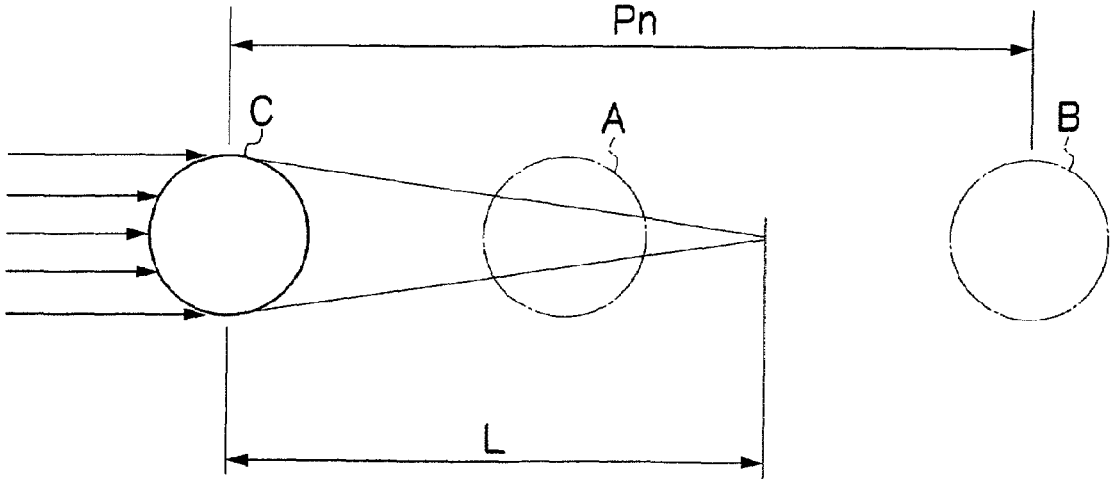
FIG. 12 is a schematic drawing showing a relationship between a distance between two droplets and a bending distance of the determination light.

FIG. 14 is an example of the variation extract signal obtained when two droplets having the positional relationship of droplets B and C shown in FIG. 12 pass through the determination light beam 94. In this case, since the two droplets are located in positions which are further apart than the specified distance L, then the light bends around the droplet C and is irradiated onto the second (rear-positioned) droplet B. The light is thereby obstructed also by the droplet B, and a large variation of the signal is thus obtained as shown in FIG. 14. The light obstructed cross-section formed by the two droplets is approximately twice as large as that formed by a single droplet (FIGS. 13A to 13C), then as shown in FIG. 14, the amount of variation in the variation extract signal of the sensor output is approximately twice as much as that in FIG. 13C.

Therefore, by previously setting a first threshold value Th1 for detecting the passage of a single droplet, and a second threshold value Th2 (where Th1<Th2 in the present embodiment) for detecting the passage of two droplets as shown in FIG. 14, it is possible to determine the number of droplets in the determination light beam 94 by comparing the variation extract signal of the sensor output with the threshold values Th1 and Th2.

If the variation extract signal exceeds the second threshold value Th2, then it can be judged that both of the nozzles are normally performing ejection, and if the variation extract signal exceeds the first threshold value Th1 but does not exceed the second threshold value Th2, then it can be judged that one of the nozzles is normal and the other is abnormal. Furthermore, if the variation extract signal is less than the first threshold value Th1, then it is judged that both of the nozzles are abnormally functioning.

On the other hand, in the case of two droplets having the relationship of droplets A and C shown in FIG. 12, since the distance between the droplets is less than the specified distance L, the light is not readily irradiated to the second droplet A (in other words, the droplet A is hidden in the shadow of the first droplet C). Consequently, even if both of the nozzles are normally ejecting droplets, the variations in the output of the determination signal are small, and the amount of variation in the variation extract signal is low as indicated by the solid line in FIG. 15. Then, the signal assumes substantially the same level as the signal for a single droplet shown in FIG. 13C, and hence the variation extract signal does not exceed the threshold value Th2. Therefore, it is not possible to judge from the variation extract signals described with reference to FIGS. 13C and 15, whether two droplets have passed, or only one droplet has passed.

Hence, when simultaneously performing determination of two droplets (i.e., ejection failure examination of two nozzles), it is necessary to control the distance between the droplets under the determination by selecting the nozzles under the examination in such a manner that the distance between the two droplets is greater than the specified distance L. Here, an embodiment relating to two droplets has been described; however, based on a similar principle, it is also possible to determine n droplets situated on the same line (where n is a number equal to 2 or greater). In this case, by simultaneously driving the n nozzles situated on a line along the optical axis, and previously establishing n levels of threshold values (Thj; where j=1, 2, . . . , n), it is possible to determine the number of droplets ejected at substantially the same time.

By setting a plurality of judgment threshold values in accordance with the number of droplets to be determined simultaneously in this way, it is possible to ascertain the number of normal nozzles (or the number of abnormal nozzles) of the plurality of nozzles under the examination. In an actual apparatus, the determination signal processing circuit or control software is provided with the aforementioned judgment threshold values to determine ejection.

When an ejection abnormality has been detected, control is implemented in order to carry out a prescribed restoring operation, droplet ejection correction, or the like. There is also a mode in which, if an abnormality has been detected as a result of ejection determination, then a second determination operation is carried out with respect to the same plurality of nozzles, in order to identify the abnormal nozzle in this second determination operation by performing ejection from one nozzle at a time or from a smaller number of nozzles than in the first determination operation, or by performing ejection while varying the combination of nozzles subject to examination.

Furthermore, it is preferable to perform a maintenance operation, such as suctioning, preliminary ejection, or the like, with respect to only the nozzle group in which any ejection abnormality has been detected. In this case, for example, the inside of the cap 64 is divided by means of partitions into a plurality of areas corresponding to the nozzle groups, thereby achieving a composition in which suction can be performed selectively in each of the demarcated areas, by means of a selector, or the like.

The determination process described above can be carried out by traversing the print head 50 with the determination light beam 94 during a printing operation. Of course, ejection determination is not limited to a mode where it is performed during a printing operation, and it is also possible to carry out ejection determination by performing an ejection operation during a non-printing operation, such as maintenance (preliminary ejection, or the like).

Principles of Determining Flight Direction Abnormality and Flight Speed Abnormality Next, the principles of determining flight direction abnormality and flight speed abnormality using the shadow region 120 created by the diffraction effect explained with reference to FIGS. 11 and 12 will be described.

Figure 16B:
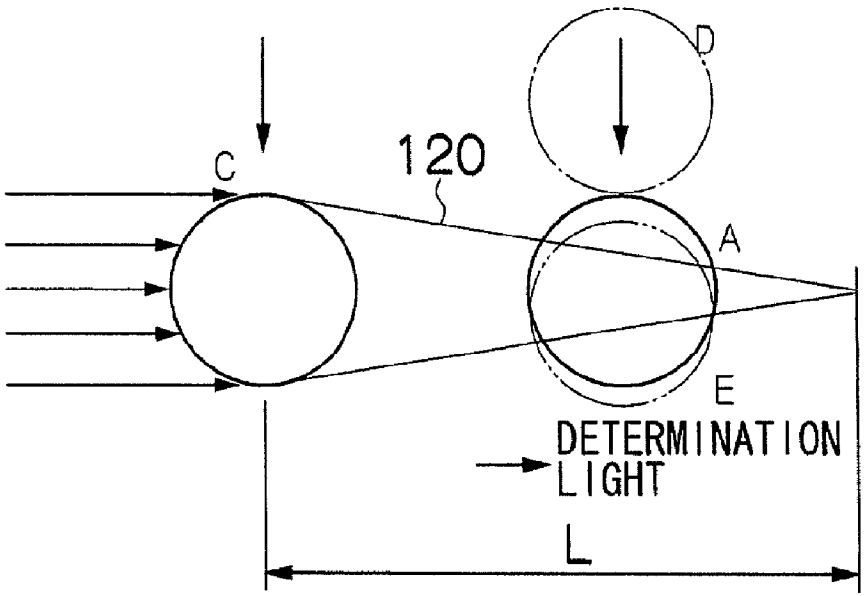
FIGS. 16A and 16B are schematic drawings for explaining principles relating to determination of flight direction abnormality and flight speed abnormality.
Figure 16A:
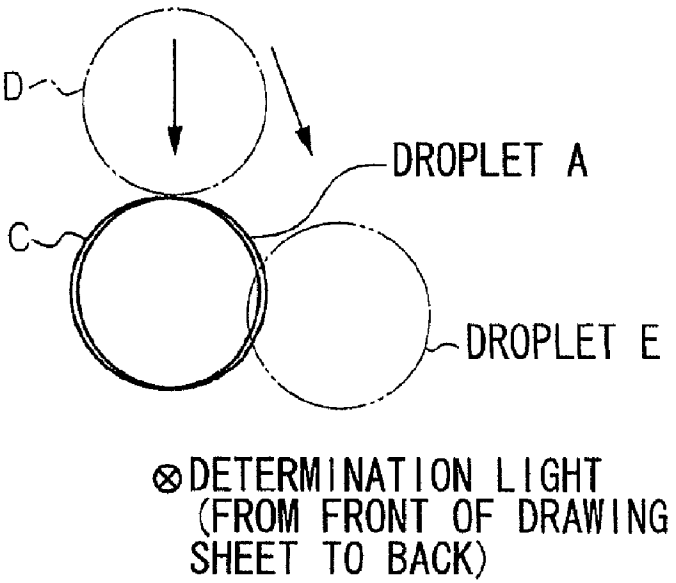

FIG. 16A is a diagram showing droplets ejected simultaneously from two nozzles, as viewed in the direction of the optical axis of the determination light. In FIG. 16A, the determination light is traveling from the front side of the drawing sheet toward the back side. FIG. 16B is a side view of FIG. 16A, and the determination light is irradiated from the left-hand side in FIG. 16B.

When two droplets are placed simultaneously into the determination light beam 94 by simultaneously driving two nozzles disposed on a line that is parallel to the optical axis of the determination light, the distance between the two droplets (in other words, the pitch in the direction of the optical axis between the two driven nozzles) is made shorter than the prescribed distance L, as shown in FIG. 16B. More specifically, two nozzles are selected which are in a positional relationship whereby the rear-positioned (downstream) droplet A in terms of the direction of travel of the determination light beam is placed in the shadow region 120 created by the forward-positioned (upstream) droplet C if the two nozzles has normally ejected the droplets A and C.

If the two selected nozzles are performing normal ejection (i.e., normal (correct) flight of the droplets in terms of the ejection direction and the ejection speed), then the two droplets overlap with each other in the cross-section of the determination light beam, as in the case of the droplets A and C shown in FIG. 16A, and sufficient light is not irradiated to the rear-positioned droplet A. Therefore, the amount of variation in the output waveform from the photosensor 27B (in other words, the waveform amplitude of the variation extract signal) is small (see the waveform indicated by the broken line in FIG. 17).

On the other hand, if there is an abnormality in the speed of flight (ejection speed) of the droplets, and a speed disparity is produced between the two droplets, then a state such as that shown by a droplet D in FIGS. 16A and 16B arises, for example. The droplet D has a slower speed of flight than the droplet C in front. Since the speed of flight is slower than the reference speed (the speed of the droplet C), the droplet D is depicted above the droplet C in FIG. 16A.

Furthermore, if an abnormality occurs in the flight direction (ejection direction) of a droplet, and a disparity in ejection direction is produced between the two droplets, then a situation such as that indicated by a droplet E in FIGS. 16A and 16B arises, for example. The flight direction of the droplet E is deviated toward the right-hand side in FIG. 16A with respect to the droplet C in front. In the side view shown in FIG. 16B, the droplet E is not separated from a position to the rear of the droplet C; however, the droplet E is displaced along the cross-section shown in FIG. 16A.

If a droplet is displaced with respect to the reference droplet C when viewed along the cross-section of the optical axis, as in the case of the droplet D or E, then light is also irradiated to the droplet D or E, as well as the droplet C, and the determination light is obstructed by the droplet D or E, thereby reducing the determination signal obtained at the photosensor 27B. In other words, since the waveform amplitude of the variation extract signal increases (see the waveform indicated by the solid line in FIG. 17), then it is possible to detect the abnormality.

Figure 17:
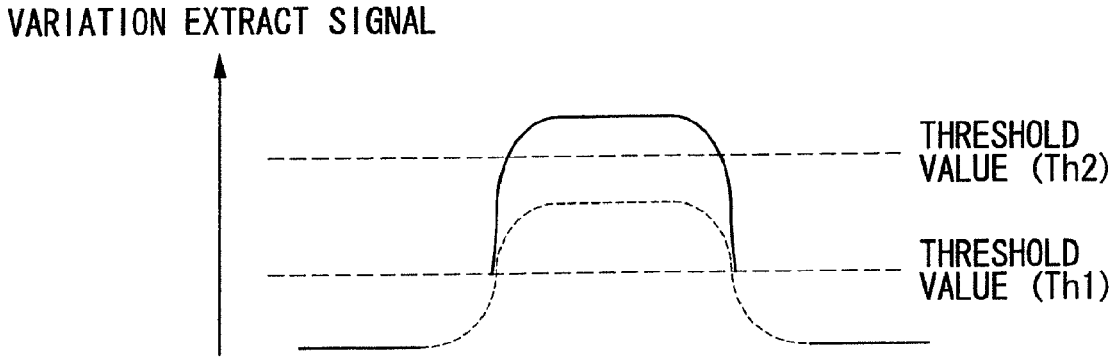
FIG. 17 is a diagram showing an example of the variation extract signal in the sensor output signal obtained when determining flight direction abnormality and flight speed abnormality.

FIG. 17 illustrates the variation in the variation extract signal of the kind described above. Originally, if two droplets are ejected in the same fashion (normal ejection), as in the case of droplet A and droplet C in FIG. 16A, then since the two droplets are substantially overlapping in the cross-section of the optical axis and are closer to each other than the specified distance L, then the output signal follows the broken line in FIG. 17. In other words, although two droplets are ejected, the amount of variation in the determination signal is small, and an output signal having little waveform variation is obtained (compare with the solid line waveform in FIG. 15).

On the other hand, if a droplet reaches a position such as that of the droplet D or the droplet E in FIGS. 16A and 16B, due to a flight speed abnormality or a flight direction abnormality, then the cross-section of the droplets obstructing the determination light increases, and hence the output signal of the waveform indicated by the solid line in FIG. 17 is obtained.

In this way, when two nozzles separated by a distance shorter than the specified distance L perform ejection at substantially the same time, then presuming that droplets are ejected from both of the nozzles (in other words, there is no ejection failure), it can be judged that the flight direction and flight speed are normal if the output from the photosensor 27B is small (namely, a waveform corresponding to one droplet only is outputted). If this is not the case, then it can be judged that there is an abnormality in the flight direction or flight speed (the flight directions or speeds are not matching). In other words, as shown in FIG. 17, threshold values Th1 and Th2 are set for the variation extract signal, and if the signal exceeds the threshold value Th2, or if it is less than the threshold value Th1, then it can be judged that an ejection error has occurred.

As described above, if flight direction abnormality and flight speed abnormality are to be determined with respect to a plurality of nozzles, then taking the distance between the centers of the two droplets (in other words, the distance between the centers of the nozzles), to be Pn, a pair of nozzles which satisfy the condition $Pn \leqq L$ are selected as nozzles for examination (see FIG. 12).

Here, the embodiment relating to two droplets has been described; however, according to a similar principle, it is possible to simultaneously determine n droplets (where n is a number equal to 2 or greater). In this case, by simultaneously driving the n nozzles situated on a line along the direction of the optical axis, and previously establishing n levels of threshold values (Thj; where j=1, 2, . . . , n), it is possible to determine the number of droplets suffering a flight abnormality among the droplets ejected at substantially the same time.

By setting a plurality of judgment threshold values in accordance with the number of droplets ejected at substantially the same time in this way, it is possible to ascertain the number of normal nozzles (or the number of abnormal nozzles) of the plurality of nozzles under examination. In an actual apparatus, the aforementioned judgment threshold values are previously stored in the determination signal processing circuit or control software, and ejection is then determined.

When an ejection abnormality has been detected, control is implemented in order to carry out a prescribed restoring operation, droplet ejection correction, or the like. There is also a mode in which, if an abnormality has been detected as a result of ejection determination, then a second determination operation is carried out with respect to the same plurality of nozzles, in order to identify the abnormal nozzle in this second determination operation by performing ejection from one nozzle at a time or from a smaller number of nozzles than in the first determination operation, or by varying the combination of nozzles which are simultaneously driven.

Furthermore, it is preferable to perform a maintenance operation, such as suctioning, preliminary ejection, or the like, with respect to only the nozzle group in which any ejection abnormality has been detected. In this case, for example, the inside of the cap 64 is divided by means of partitions into a plurality of areas corresponding to the nozzle groups, thereby achieving a composition in which suction can be performed selectively in each of the demarcated areas, by means of a selector, or the like.

The determination process described above can be carried out by traversing the print head 50 with the determination light beam 94 during a printing operation. Of course, ejection determination is not limited to a mode where it is performed during a printing operation, and it is also possible to carry out ejection determination by performing an ejection operation during a non-printing operation, such as maintenance (preliminary ejection, or the like).

Here, an embodiment of the relationship between the nozzles 51 subject to examination and the optical axis of the determination light beam 94 will be described with reference to FIGS. 18 to 20.

Figure 18:
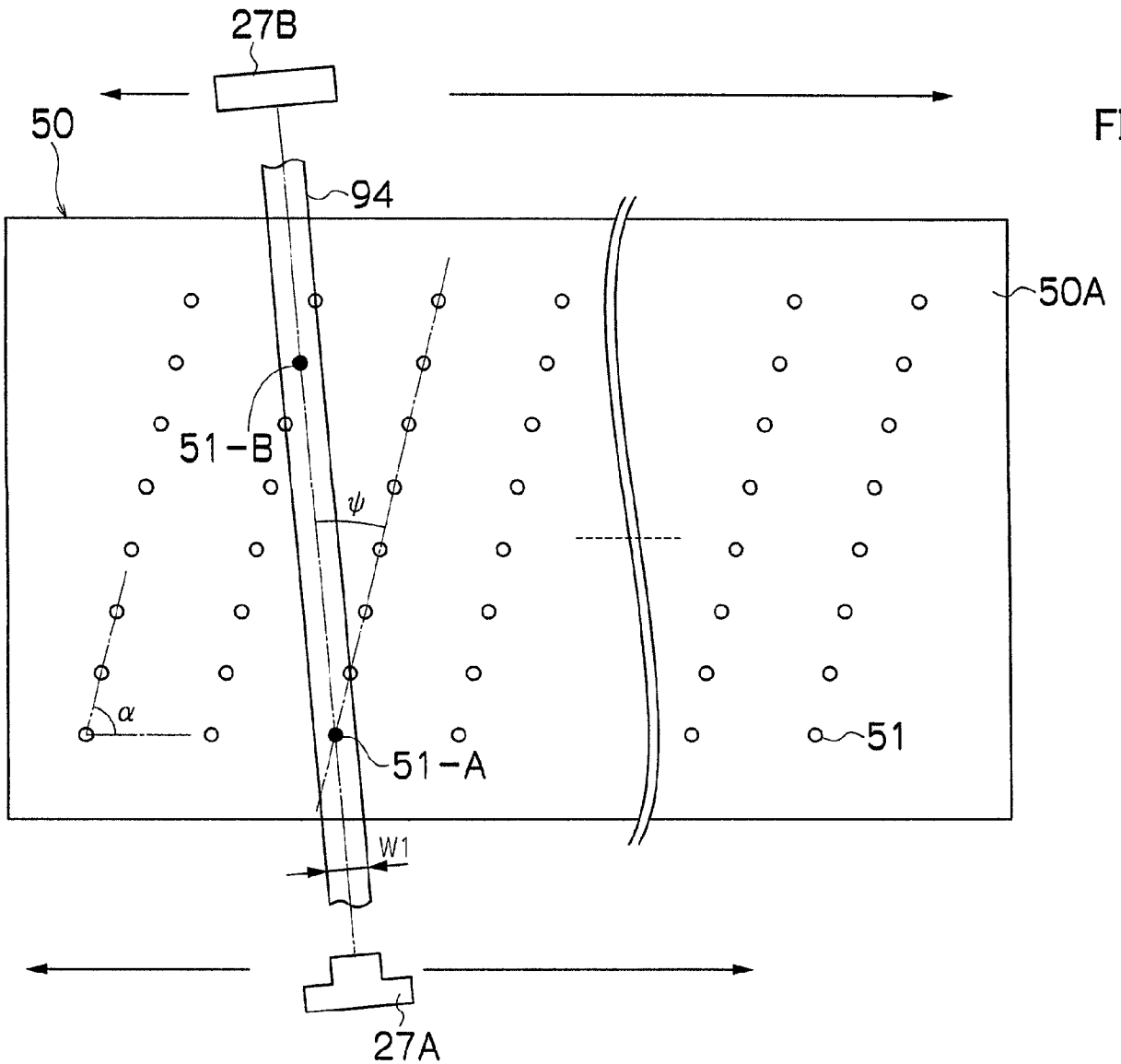
FIG. 18 is a schematic diagram showing an example of a relationship between the nozzles to be examined and the determination light beam.

FIG. 18 is a plan view schematic drawing showing an embodiment in which two nozzles for examination are selected from two-dimensionally arranged nozzle rows. FIG. 18 shows a view from the nozzle surface of the print head (this also applies to FIGS. 19 and 20). In the embodiment shown in FIG. 18, the optical axis of the determination light beam 94 forms an angle of $\psi$ (where $\psi>0$) with respect to the direction of arrangement of the nozzles 51, which are aligned in an oblique column direction at an angle of $\alpha$ with respect to the lengthwise direction of the print head 50 (the horizontal direction in FIG. 18), and the plurality of nozzles 51 under examination are disposed on a line that is parallel to the optical axis of the determination light beam 94 having a beam width of W1. A determination optical system which creates the determination light beam 94 of this kind is provided.

More specifically, the nozzles 51-A and 51-B indicated by the solid circles in FIG. 18 are the nozzles to be examined, and droplets are ejected at substantially the same time from these nozzles 51-1 and 51-B, which are located in different nozzle columns. Here, "ejected at substantially the same time" means "simultaneously" in terms of the application timings of the drive signals applied to the actuators that drive ejection in the nozzles 51-A and 51-B, and "strict simultaneousness" in terms of the actual ejection timings of the droplets is not required.

The nozzles under examination are changed by moving the determination light beam 94 in FIG. 18 relatively with respect to the nozzle arrangement, by means of the scanning device 102 shown in FIG. 9.

Figure 19:
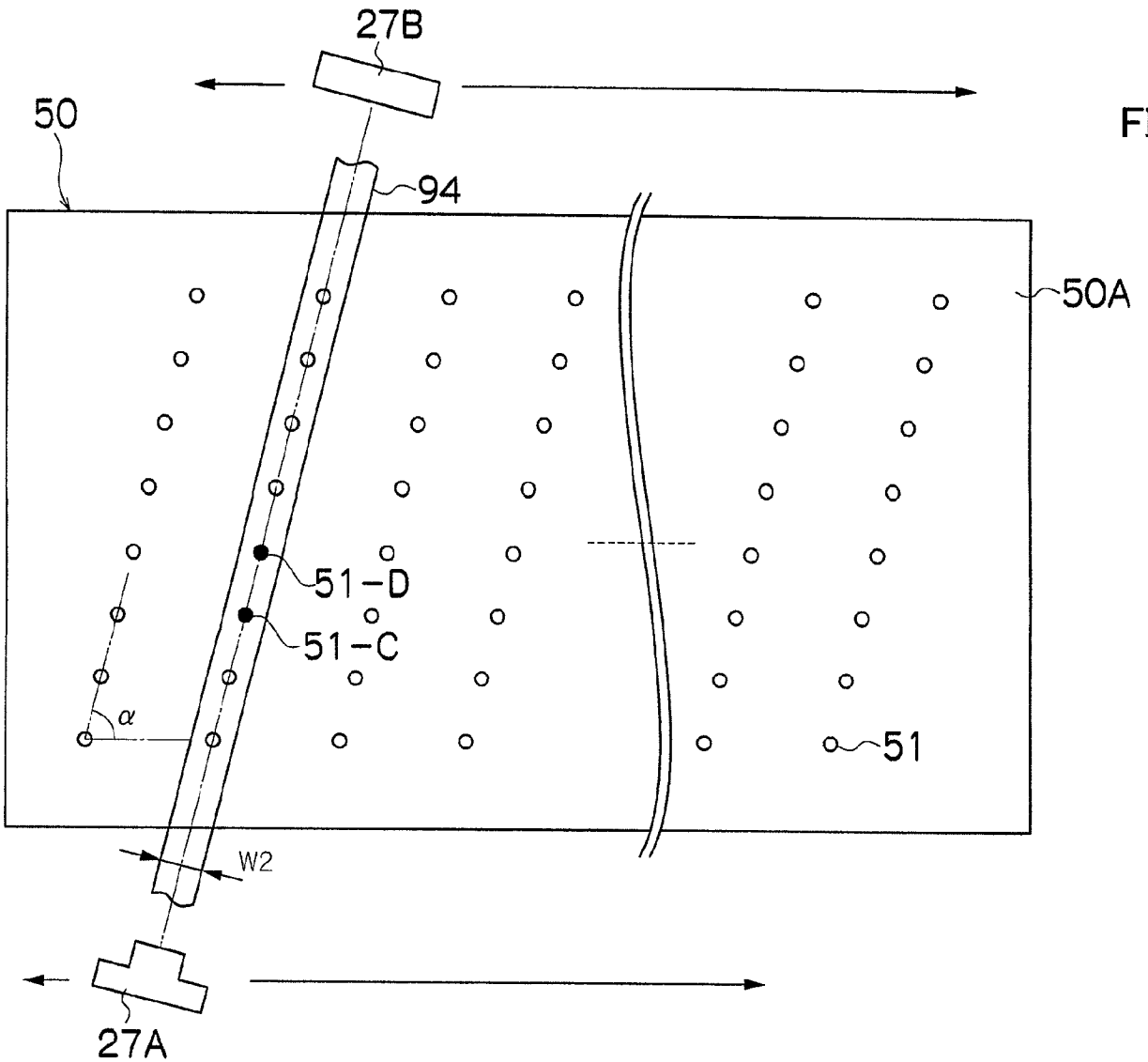
FIG. 19 is a schematic diagram showing another example of the relationship between the nozzles to be examined and the determination light beam.

FIG. 19 is a plan view schematic drawing showing a further embodiment in which two nozzles are selected for examination from two-dimensionally arranged nozzle rows. In the embodiment shown in FIG. 19, a determination optical system is provided in such a manner that the optical axis of the determination light beam 94 is parallel with the direction of arrangement of the nozzles 51 which are aligned in an oblique column direction at an angle of $\alpha$ with respect to the lengthwise direction of the print head 50 (the horizontal direction in FIG. 19), and the droplets ejected from the plurality of nozzles 51 under examination pass through substantially the same position in the cross-section of the determination light beam 94 having a beam width of W2.

More specifically, the nozzles 51-C and 51-D indicated by the solid circles in FIG. 19 are nozzles to be examined, and droplets are ejected at substantially the same time from these nozzles 51-C and 51-D, which are located in the same nozzle column. If an ejection failure is to be determined on the basis of the determination principles shown in FIGS. 12 to 15, then nozzles that are separated by a distance greater than the specified distance L are selected. On the other hand, if a flight direction abnormality and a speed abnormality are to be determined on the basis of the determination principles shown in FIGS. 16A to 17, then nozzles that are separated by a distance smaller than the specified distance L are selected.

Furthermore, the nozzle row under examination can be changed by moving the determination light beam 94 in FIG. 19 by means of the scanning device 102 shown in FIG. 9.

Figure 20:
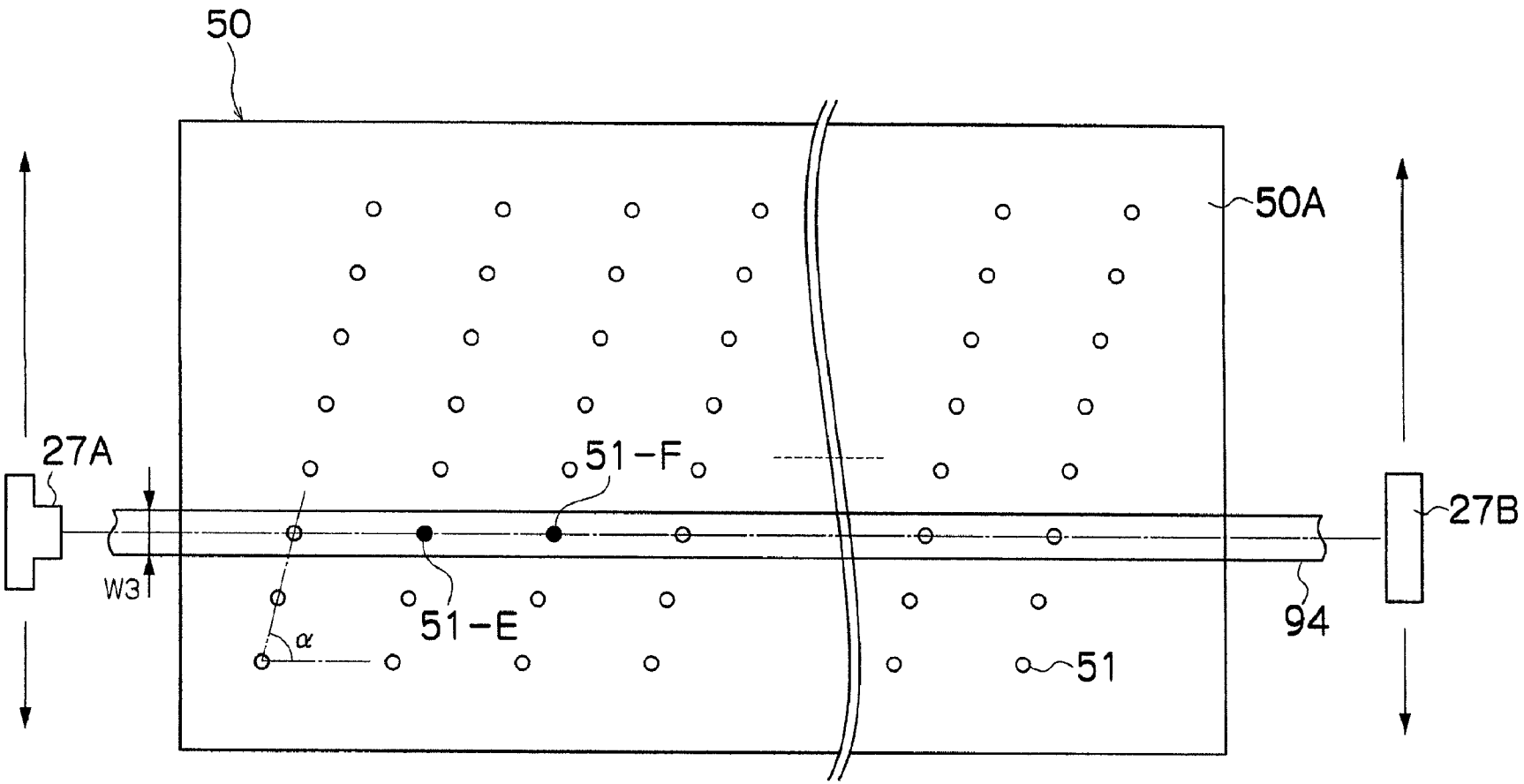
FIG. 20 is a diagram showing a further example of the relationship between the nozzles to be examined and the determination light beam.

FIG. 20 is a plan view schematic drawing showing yet a further embodiment in which two nozzles are selected for examination from two-dimensionally arranged nozzle rows. In the embodiment shown in FIG. 20, a determination optical system is provided in such a manner that the optical axis of the determination light beam 94 is parallel with the nozzle rows aligned in the main scanning direction of a full line head, and the droplets ejected from a plurality of nozzles 51 under examination pass through substantially the same position in the cross-section of the determination light beam 94, which has a beam width of W3.

More specifically, the nozzles 51-E and 51-F indicated by the solid circles in FIG. 20 are nozzles to be examined, and droplets are ejected at substantially the same time from these nozzles 51-E and 51-F, which are located in the same nozzle row. If an ejection failure is to be determined on the basis of the determination principles shown in FIGS. 12 to 15, then nozzles that are separated by a distance greater than the specified distance L are selected. On the other hand, if a flight direction abnormality and a speed abnormality are to be determined on the basis of the determination principles shown in FIGS. 16A to 17, then nozzles that are separated by a distance smaller than the specified distance L are selected.

Furthermore, the nozzle row under examination can be changed by moving the determination light beam 94 in FIG. 20 by means of the scanning device 102 shown in FIG. 9.

The cross-sectional shape and area of the determination light beam 94 are set appropriately in consideration of the number of droplets to be simultaneously determined, the positional relationship between the nozzles 51 to be examined, and the time difference between their ejection timings, and the like. For example, if a resolution of 2,400 dpi (dots per inch) is achieved, then the dot pitch is substantially 10 μm, and the droplets in flight (spherical droplets) have a diameter of substantially 15 μm. If the cross-sectional area of the determination light beam 94 is increased, then the ratio of the cross-section obstructed by the ejected droplets becomes smaller, and hence the S/N ratio deteriorates. Consequently, it is desirable to use as narrow a beam as possible in order to prevent the plurality of droplets under examination from overlapping with each other, spatially and/or temporally.

It is more preferable that the beam shape is variable, and the beam shape is controlled and changed automatically to a suitable shape, according to the circumstances. By optimizing the beam shape and thus increasing the obstructing ratio of the droplets with respect to the cross-sectional area of the beam, it is possible to achieve highly accurate determination having a good S/N ratio. The device for changing the beam shape of the determination light is described later.

Control Procedure

Next, an ejection determination procedure in the inkjet recording apparatus 10 according to the present embodiment will be described.

Figure 21:
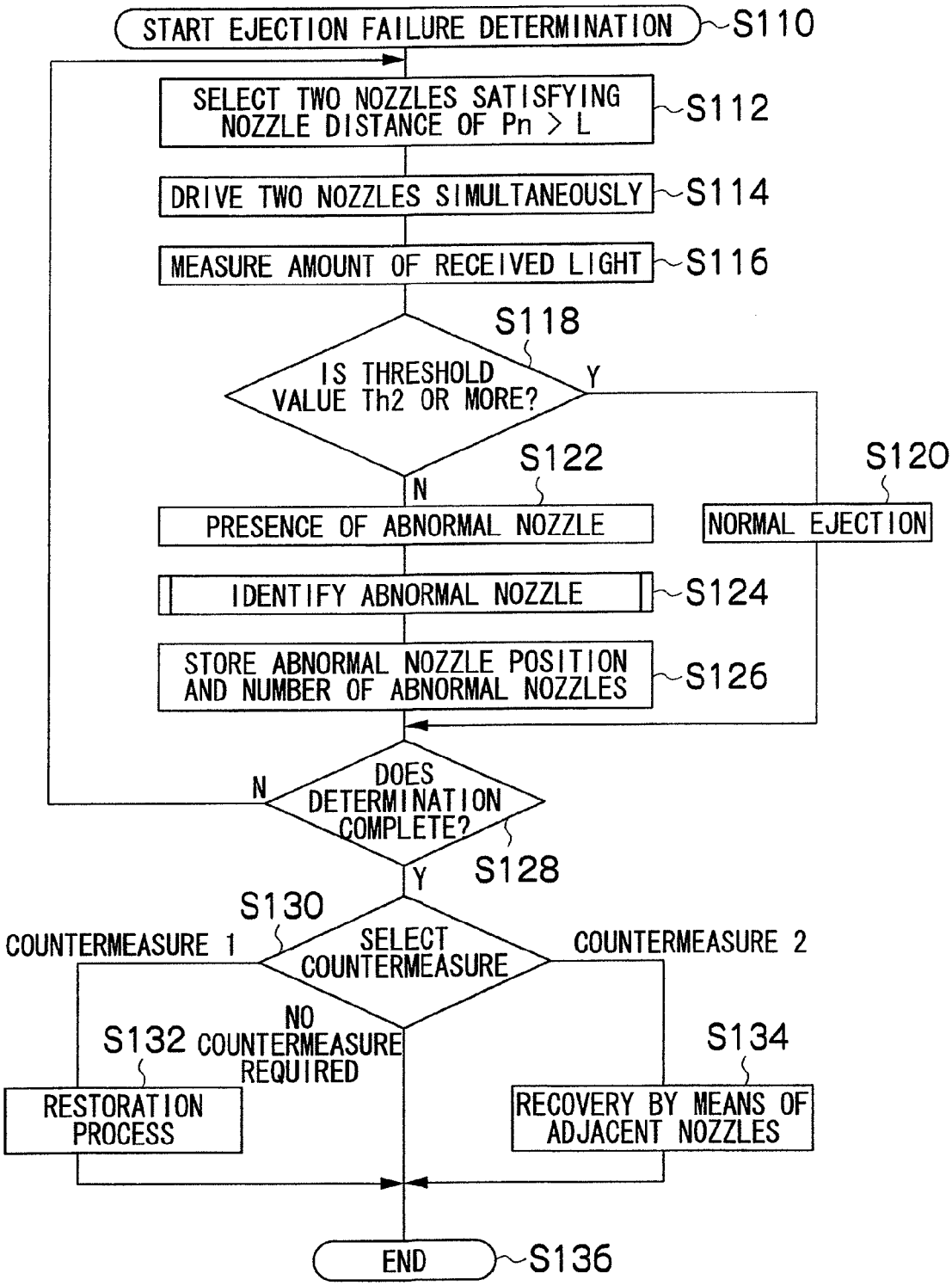
FIG. 21 is a flowchart showing a control procedure of determining ejection failure.

FIG. 21 is a flowchart showing an embodiment of control for determining ejection failure. When the ejection failure determination procedure is started (step S110), firstly, two nozzles having a positional relationship whereby the distance between the nozzles Pn is greater than the specified distance L (two nozzles satisfying the relationship Pn>L) are selected from a nozzle row aligned on a straight line parallel to the optical axis of the determination light (step S112). The information relating to the specified distance L is stored in a storage device, such as the ROM 75 shown in FIG. 8. Furthermore, the position of the optical axis of the determination light is ascertained on the basis of control information for the scanning device 102 shown in FIG. 9, or determination information from the position determination device.

The two actuators of the two nozzles thereby selected so as to satisfy the aforementioned conditions are simultaneously driven (step S114), and droplets are ejected at substantially the same time from the two nozzles. The amount of light received by the photosensor following the ejection operation is measured (step S116), and the variation extract signal of the determination signal obtained from the photosensor is compared with the threshold value Th2 (step S118). If the variation extract signal of the determination signal is equal to or greater than the prescribed threshold value Th2 at step S118, then it is judged that the ejection has been normally performed (step S120). On the other hand, if the variation extract signal of the determination signal is less than the prescribed threshold value Th2 at step S118, then it is recognized that there is an ejection abnormality in at least one of the two nozzles (step S122).

Figure 22:
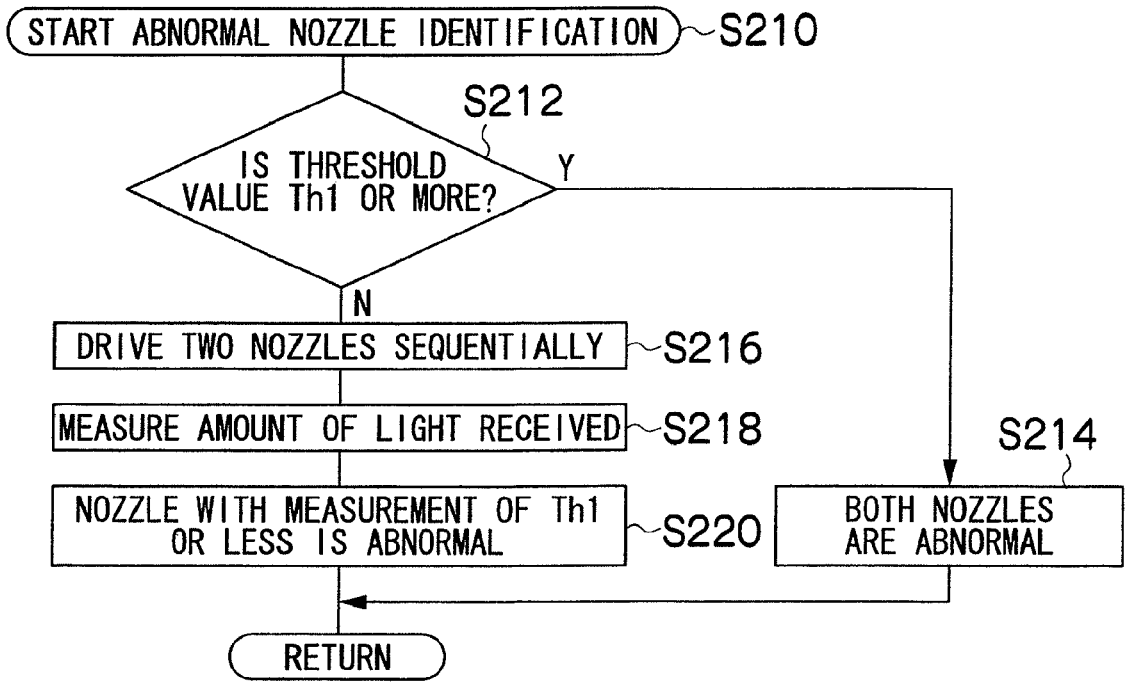
FIG. 22 is a flowchart showing a control procedure of identifying abnormal nozzles.

In this case, the procedure transfers (step S124) to a special procedure (FIG. 22) for abnormal nozzles. As shown in FIG. 22, when the special processing for abnormal nozzles is started (step S210), firstly, the variation extract signal of the determination signal is compared with the threshold value Th1 (step S212). If the variation extract signal of the determination signal is equal to or less than the threshold value Th1, then it is judged that both of the two nozzles each have suffered an ejection failure (step S214).

If, at step S212, the variation extract signal exceeds the threshold value Th1, then either one of the two nozzles has suffered an ejection failure, and in order to identify which of the two nozzles has suffered the ejection failure, the two nozzles are driven sequentially at different ejection timings (step S216).

The amount of light received is measured synchronously with the drive timing of each nozzle (step S218), and a variation extract signal of the determination signal is obtained for each nozzle ejection operation. The variation extract signals thereby obtained are compared with the threshold value Th1, and the nozzle for which the variation extract signal is equal to or less than the threshold value Th1 is judged to be the abnormal nozzle (step S220). When the abnormal nozzle has been identified in step S214 or S220, the procedure returns to the flowchart in FIG. 21, and advances to step S126.

At step S126 in FIG. 21, processing for storing the positions of the abnormal nozzles thus identified and the number of abnormal nozzles is carried out. The device for storing this information may be an internal memory of the apparatus or it may be a detachable, external storage device (a removable medium).

Next, it is judged whether or not determination has been completed (step S128). This judgment is made on the basis of whether or not examination has been completed for all of the nozzles of the print head, or whether or not examination has been completed for the nozzles previously selected for examination (a portion of the nozzle group), or whether or not the number of abnormal nozzles stored at step S126 has reached a specific value.

At step S128, if determination has not been completed, then the procedure returns to step S112, another two nozzles are selected by changing the nozzles under examination, and the processing in steps S112 to S128 is repeated.

At step S128, if it is judged that determination has been completed, then the procedure advances to step S130. At step S130, a judgment is made for selecting what kind of countermeasures are to be implemented, in accordance with the determination results. Table data which defines a mutual association between the determination results and countermeasures is stored previously in an internal memory of the apparatus (and desirably, a non-volatile storage device), and processing contents are determined in accordance with this table.

For example, if the ratio of the abnormal nozzles with respect to the total number of nozzles has exceeded a specified value, then ejection is halted, and a restoration process, such as nozzle suctioning, or the like, is carried out (step S132). Alternatively, if the number of abnormal nozzles is relatively small and the image can be covered by the use of substitute droplet ejection by the adjacent nozzles, then recovery by means of the adjacent nozzles is carried out (in other words, substitute droplet ejection onto the image is performed by the nozzles adjacent to the nozzles suffering ejection failure) (step S134). Another alternative is a mode in which processing such as an error display is carried out instead of, or in addition to, the restoration processing (step S132) and the recovery processing (step S134). On the other hand, if no abnormal nozzle is detected, then it is judged that no countermeasure is required, and the present procedure terminates without carrying out any countermeasures (step S136).

According to the method described in FIGS. 21 and 22, since nozzles in positions separated by a distance greater than a prescribed distance in the direction of the optical axis of the determination light are selected as nozzles for simultaneous determination, it is possible to simultaneously determine a plurality of droplets, and hence the determination duration can be shortened. Thereby, it is possible to improve the overall printing throughput. Moreover, if an abnormal nozzle has been detected, then countermeasures, such as restoration processing, or recovery, are carried out, and it is possible to thus improve print quality.

In the foregoing description, when an abnormal nozzle has been detected, the abnormal nozzle is identified by sequentially performing ejection from the nozzles that have simultaneously performed ejection (FIG. 22); however, it is also possible to identify the abnormal nozzle by changing the combination of the nozzles ejecting droplets.

Next, a case where an abnormality in the flight direction and the flight speed is determined will be described.

Figure 23:
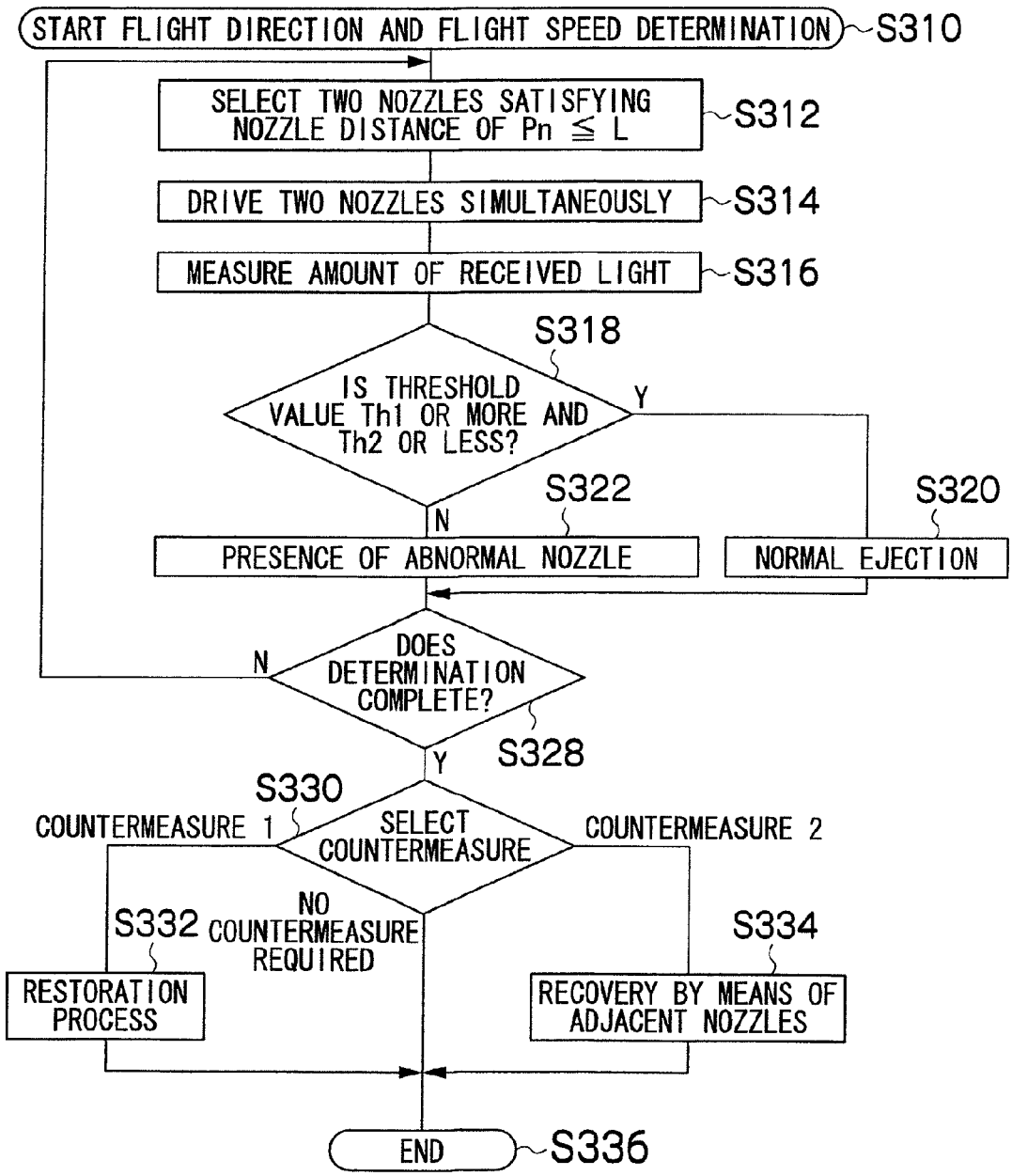
FIG. 23 is a flowchart showing a control procedure of determining flight direction abnormality and flight speed abnormality.

FIG. 23 is a flowchart showing an embodiment of control for determining an abnormality in the flight direction and the flight speed. When the flight direction and flight speed abnormality determination procedure is started (step S310), firstly, two nozzles having a positional relationship whereby the distance between the nozzles Pn is equal to or less than the specified distance L (two nozzles satisfying the relationship $Pn \leqq L$) are selected from nozzles aligned on a straight line parallel to the optical axis of the determination light (step S312).

The two actuators of the two nozzles thereby selected are simultaneously driven (step S314), and droplets are ejected at substantially the same time from the two nozzles. The amount of light received by the photosensor following the ejection operation is measured (step S316), and the variation extract signal is compared with the threshold values Th1 and Th2 (step S318). If the variation extract signal is equal to or greater than the first threshold value Th1 and equal to or less than the second threshold value Th2, then the two nozzles are judged to be normally performing ejection.

On the other hand, at step S318, if the variation extract signal of the determination signal is less than the first threshold value Th1, or if it is greater than the second threshold value Th2, then it is judged that there is an abnormality in at least one of the ejection direction and the ejection speed (step S322).

After step S322 or step S320, the procedure advances to step S328, and it is judged whether or not determination has been completed. This judgment (step S328) is made on the basis of whether or not examination has been completed for all of the nozzles of the print head, or whether or not examination has been completed for the nozzles previously selected for examination (a portion of the nozzle group), whether or not an abnormal nozzle has been detected, or the like.

At step S328, if the determination has not finished, then the procedure returns to step S312, another two nozzles are selected by changing the nozzles under examination, and the processing in steps S312 to S328 is repeated.

At step S328, if it is judged that the determination has been completed, then the procedure advances to step S330. At step S330, a judgment is made for selecting what kind of countermeasures are to be implemented, in accordance with the determination results. Table data which defines a mutual association between the determination results and countermeasures is stored previously in an internal memory of the apparatus (and desirably, a non-volatile storage device), and processing contents are determined in accordance with this table.

For example, if an abnormal nozzle has been detected, then ejection is halted, and a restoration processing, such as nozzle suctioning, or the like, is carried out (step S332). Alternatively, if an abnormal nozzle has been detected but the image can be covered by the use of substitute droplet ejection by adjacent nozzles, then recovery by means of the adjacent nozzles is carried out (in other words, substitute droplet ejection onto the image by the nozzles adjacent to the nozzles suffering ejection failure) (step S334). Another alternative is a mode in which processing such as an error display is carried out instead of, or in addition to, the restoration processing (step S332) and the recovery processing (step S334). On the other hand, if no abnormal nozzle is detected, then it is judged that no countermeasure is required, and the present procedure terminates without carrying out any countermeasures (step S336).

If an abnormal nozzle has been detected, then similarly to the embodiment shown in FIG. 22, it is possible to identify the abnormal nozzle either by sequentially performing ejection from the nozzles that have simultaneously performed ejection, or by changing the combination of nozzles performing ejection.

According to the method shown in FIG. 23, it is possible to determine a flight direction abnormality and a flight speed abnormality with a high degree of accuracy. Moreover, if an abnormal nozzle has been detected, then countermeasures, such as restoration processing, or recovery, are carried out, and it is possible to thus improve print quality.

In the above-described embodiments, a procedure for determining ejection failure (FIGS. 21 and 22) and a procedure for determining ejection direction abnormality and ejection speed abnormality (FIG. 23) are carried out independently; however, a control mode in which these procedures are appropriately combined is also possible.

Figure 24:
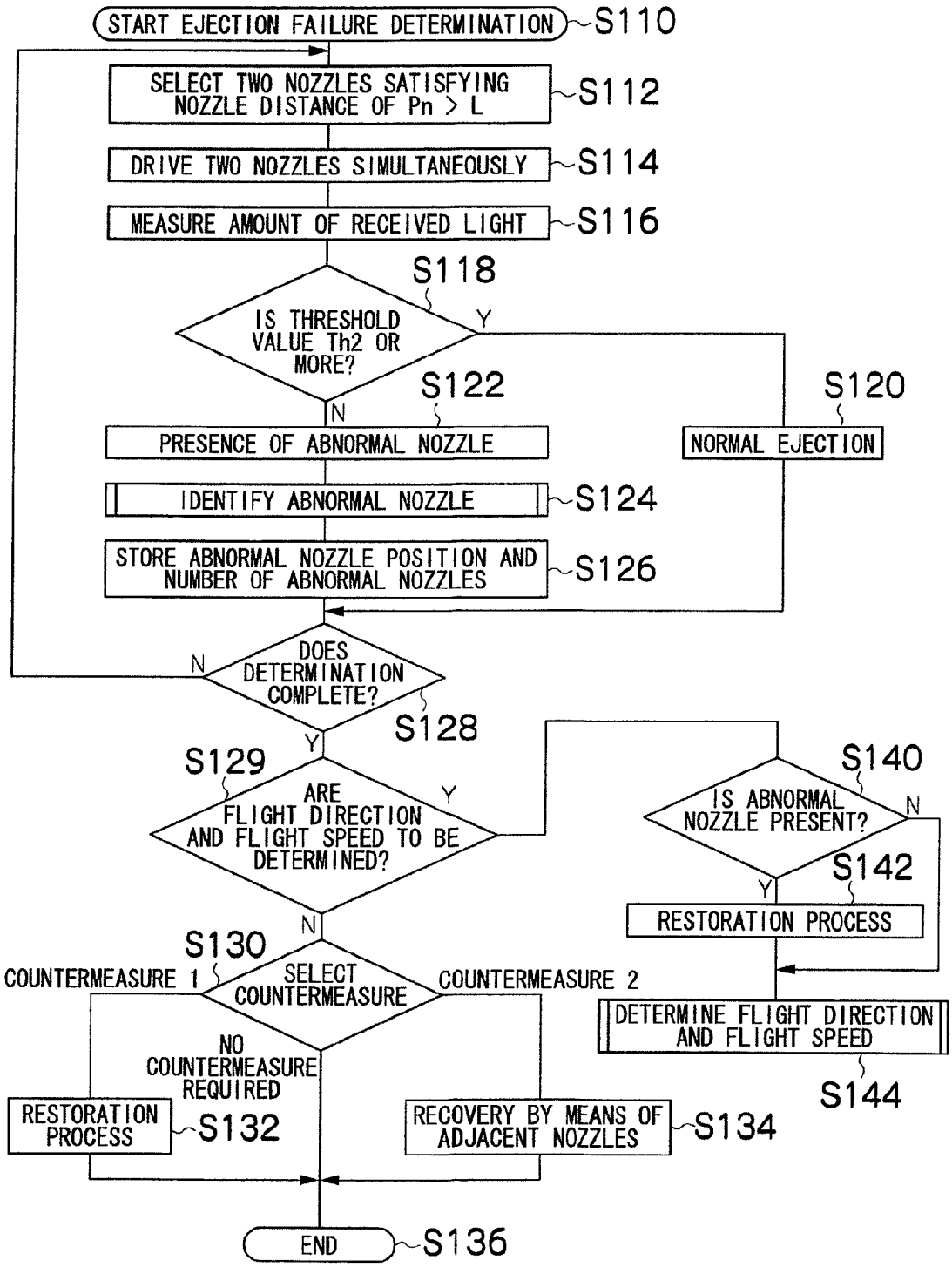
FIG. 24 is a flowchart showing a control procedure of determination which combines a determination of ejection failure and a determination of flight direction abnormality and flight speed abnormality.

FIG. 24 is a flowchart showing a determination procedure in which an ejection failure determination procedure and a flight direction and flight speed abnormality determination procedure are combined.

In FIG. 24, steps which are the same as or similar to those in the flowcharts in FIGS. 21 to 23 are denoted with the same step numbers and description thereof is omitted here.

The flowchart in FIG. 24 has the additional judgment step in S129, compared to FIG. 21. This judgment is a process which selects whether or not to perform determination of ejection direction abnormality and ejection speed abnormality, following the determination of ejection failure. The judgment may be made on the basis of a determination mode designated by the user via a prescribed input device (a user interface, or the like), or it may be made automatically by a program on the basis of time management, such as a timer, or other prescribed conditions.

At step S129, if it is judged that ejection direction abnormality and ejection speed abnormality are not to be determined, then the procedure advances to step S130, whereupon, processing such as restoration processing, recovery processing, error display, or the like, are carried out in accordance with the ejection failure determination result, as described in FIG. 21 (steps S130 to S136).

On the other hand, if it is judged at step S129 that flight direction abnormality and flight speed abnormality are to be determined, then the procedure advances to step S140. At step S140, the presence or absence of ejection failure nozzles is judged in accordance with the ejection failure determination results. If a nozzle suffering an ejection failure has been detected, then restoration processing (step S142) is carried out and the ejection failure is corrected, whereupon the procedure transfers to flight direction and flight speed abnormality determination procedure (described with reference to FIG. 23) (step S144 in FIG. 24).

At step S140, if no nozzle having ejection failure is detected, then the restoration processing (step S142) is omitted and the procedure transfers to the flight direction and flight speed abnormality determination procedure (described with reference to FIG. 23) (step S144 in FIG. 24).

This is because that the flight direction and flight speed abnormality determination process shown in FIG. 23 is performed on the premise that the nozzles under examination have no ejection failure. If an ejection failure is detected in the preceding ejection failure determination procedure, then restoration processing, such as nozzle suctioning, is carried out and the nozzle suffering the ejection failure is mended, whereupon the procedure transfers to the subsequent ejection direction and ejection speed abnormality determination procedure.

When a nozzle produces an ejection failure, a flight direction abnormality or flight speed abnormality occurs firstly, and an ejection failure develops subsequently. Therefore, it is also possible to adopt a procedure for ejection determination in which flight direction and flight speed abnormality determination is carried out firstly, whereupon determination of ejection failure is carried out.

Device for Changing Beam Shape of Determination Light

Here, the composition for controlling the cross-sectional shape of the determination light beam 94 will be described. The lens system that changes the parallel light of a certain width into parallel light of a different width is generally constituted by an optical system similar to a telescope. When an object at infinity is observed through a telescope, then the incident light is parallel light and the light emitted from the eyepiece lens is also parallel light. If light is incident to the eyepiece lens to the telescope optical system and emitted from the objective lens, then the telescope optical system functions as a beam expander. Embodiments of the basic composition of the optical system of this kind are described below.

Figure 25A:
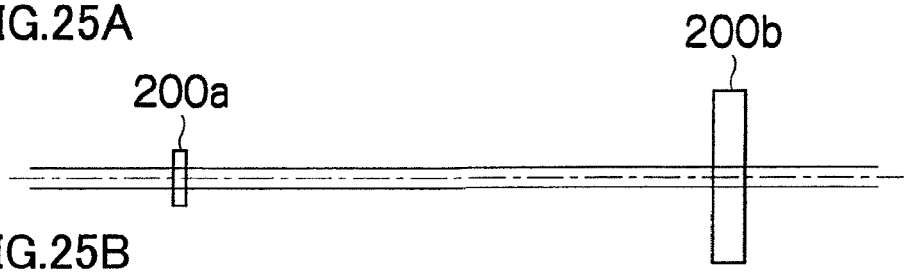
FIGS. 25A and 25B are a plan view and a side view, respectively, showing schematically a first embodiment of the optical system converting a parallel light into a parallel light having a different width.
Figure 25B:
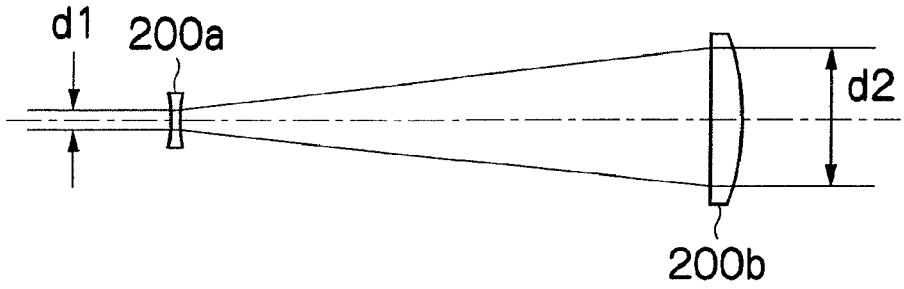

FIGS. 25A and 25B show a first embodiment illustrating the basic composition of the optical system that converts parallel light of a certain width into parallel light of a different width. FIG. 25A is a plan diagram of the optical system as viewed from above, and FIG. 25B is a diagram in which the optical system is viewed from the side (from the front face). In other words, FIGS. 25A and 25B respectively show diagrams viewed from two directions that are perpendicular to the optical axis. The light is taken to be incident from the left-hand side in FIGS. 25A and 25B. Below, the relationship between the drawings "A" and "B" in each of pairs of FIGS. 26A and 26B, 27A and 27B, 28A and 28B, 29A and 29B, 30A and 30, and 31A and 31B, and the direction of travel of the incident light are taken to be the same as those in FIGS. 25A and 25B.

The composition shown in FIGS. 25A and 25B is the Galileo type beam expander optical system. In the particular direction shown in FIG. 25B of the two axes that are perpendicular to the optical axis, a lens 200*a* is a concave lens, which causes the light to diverge, a lens 200*b* is a convex lens, and the lens 200*a* and the lens 200*b* thereby function as a beam expander, which converts the beam width from d1 to d2. On the other hand, in the other direction perpendicular to the optical axis, the lenses 200*a* and 200*b* have zero optical power as shown in FIG. 25A. In other words, the lenses 200*a* and 200*b* are cylindrical lenses, and compose a cylindrical type beam expander, which can form a parallel light beam having a rectangular shape of different sizes in the vertical and horizontal directions in the cross section.

Figure 26A:
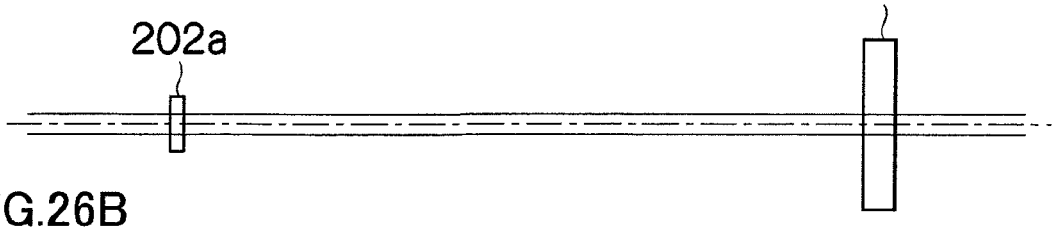
FIGS. 26A and 26B are a plan view and a side view, respectively, showing schematically a second embodiment of the optical system converting a parallel light into a parallel light having a different width.
Figure 26B:
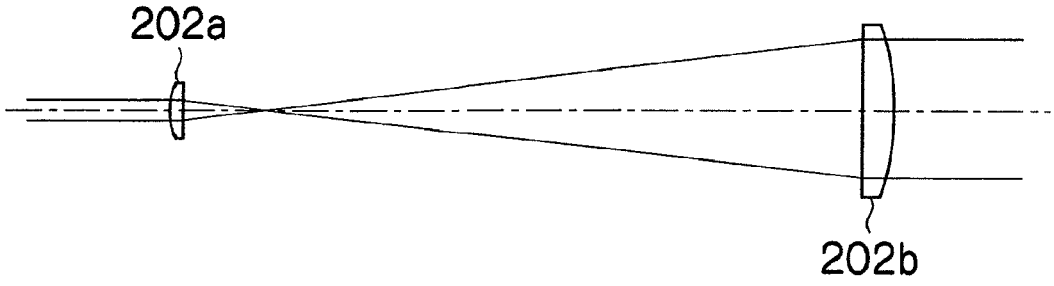

FIGS. 26A and 26B show a second embodiment illustrating the basic composition of the optical system that converts parallel light of a certain width into parallel light of a different width. This second embodiment is the Kepler type beam expander optical system. In the particular direction shown in FIG. 26B of the two axes that are perpendicular to the optical axis, lenses 202*a* and 202*b* are both convex lenses, which function as a beam expander and change the beam width. On the other hand, in the other direction perpendicular to the optical axis, the lenses 202*a* and 202*b* have zero optical power as shown in FIG. 26A. In other words, the lenses 202*a* and 202*b* are cylindrical lenses, and compose a cylindrical type beam expander.

Either of the optical system in FIGS. 25A and 25B and the optical system in FIGS. 26A and 26B can be used as the beam expander.

Figure 27A:
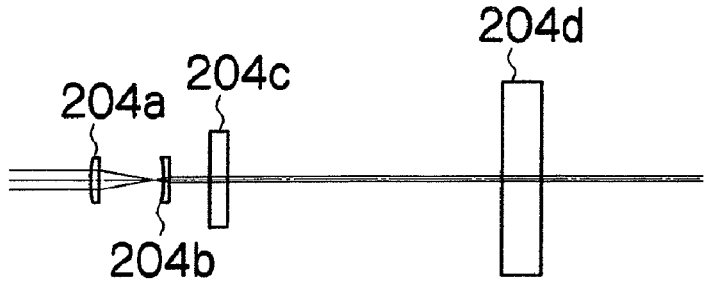
FIGS. 27A and 27B are a plan view and a side view, respectively, showing schematically a third embodiment of the optical system converting a parallel light into a parallel light having a different width.
Figure 27B:
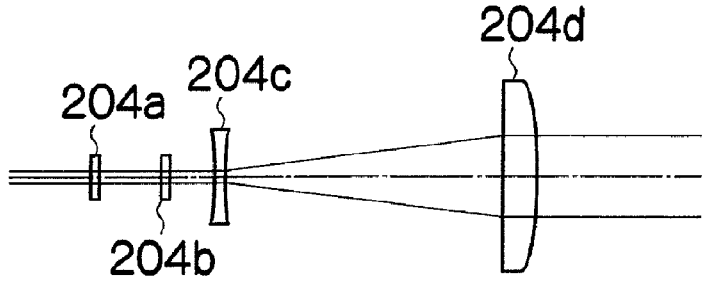

Further, a third embodiment of the basic composition of the optical system is shown in FIGS. 27A and 27B, wherein two Galileo type beam expanders as shown in FIGS. 25A and 25B having respectively different focal lengths are coupled together in series in a mutually facing arrangement. More specifically, in the direction shown in FIG. 27A, the parallel light beam is narrowed by the beam expander in the front light input stage composed of a convex lens 204*a* and a concave lens 204*b*. In the direction shown in FIG. 27B, the parallel light beam is broadened by the beam expander in the following light input stage composed of a concave lens 204*c* and a convex lens 204*d*.

Figure 28A:
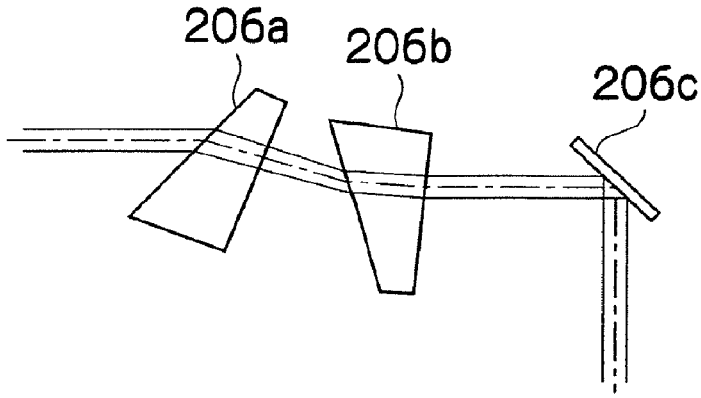
FIGS. 28A and 28B are a plan view and a side view, respectively, showing schematically a fourth embodiment of the optical system converting a parallel light into a parallel light having a different width.
Figure 28B:
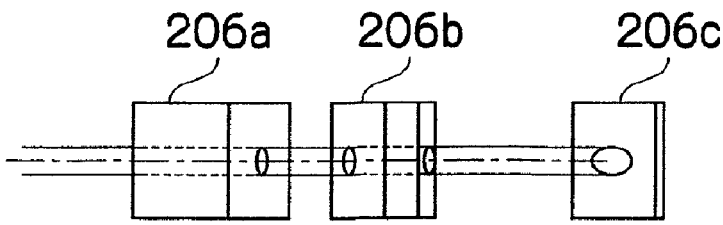

Furthermore, FIGS. 28A and 28B show a fourth embodiment of the basic composition of the optical system. This embodiment uses a beam expander based on a pair of anamorphic prisms. As shown in FIGS. 28A and 28B, by using quadrilateral prisms 206*a* and 206*b* each having a trapezoid cross-section, it is possible to change the width of the emitted light beam in a continuous fashion, in accordance with the angle of incidence of the parallel light (see also FIGS. 31A and 31B). By using the pair of prisms 206*a* and 206*b* and disposing them in a suitable positional relationship, it is possible to make the incident light axis and the emitted light axis mutually parallel (although the two axes do not coincide with each other). Moreover, by using the two prisms 206*a* and 206*b*, it becomes possible to change the width of the parallel light beam through a greater range.

Moreover, in FIGS. 28A and 28B, a plane mirror 206*c* is disposed after the prisms 206*a* and 206*b*, and the optical axis of the parallel light after width conversion can be uniform by adjusting the position of the mirror 206*c*. Furthermore, in this case, the optical axis of the light just after passing through the prisms 206*a* and 206*b* does not have to be parallel with the incident light, and it is possible to ensure that the optical axis of the emitted light after reflection by the mirror 206*c* is uniform at all times, by simultaneously adjusting the position and angle of the mirror 206*c*.

Next, embodiments of the composition of the optical system which can vary the width of the parallel light beam, in other words, change the relationship between the widths of the incident light and the emitted light, will be described.

In the system using the lenses as shown in FIGS. 25A and 25B or FIGS. 26A and 26B described above, a commonly known zoom type optical system is used for one or both of the incident side lens on the left-hand side in the diagrams and the emitting side lens on the right-hand side, and by altering the focal length of the zoom type optical system, the relationship between the widths of the incident light and the emitted light can be varied in a continuous fashion. In this case, a zoom optical system is formed using cylindrical lenses, such as those shown in FIGS. 25A to 26B.

Figure 29A:
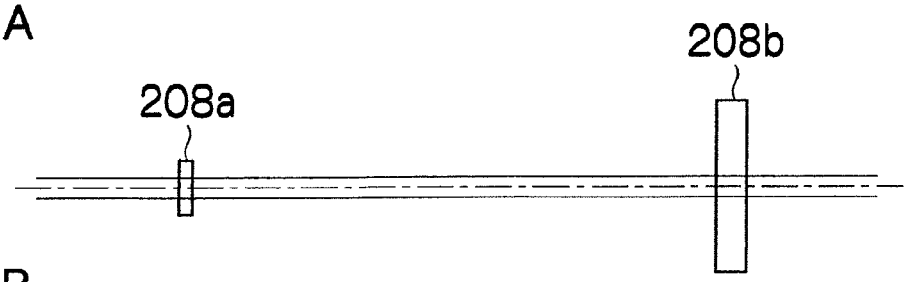
FIGS. 29A and 29B are a plan view and a side view, respectively, showing schematically a first embodiment of the optical system which alters a width of parallel light.
Figure 29B:
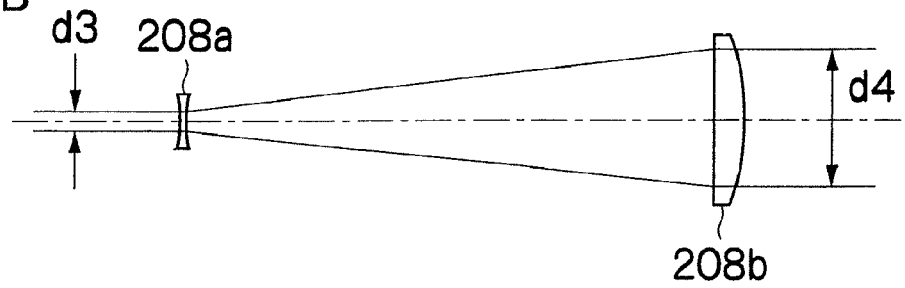

FIGS. 29A and 29B show a first embodiment of the composition of the optical system in which the width of the parallel light can be varied. This embodiment uses a similar optical system to that shown in FIGS. 25A and 25B, being constituted by a lens 208*a* which is a concave lens in one direction perpendicular to the optical axis and a cylindrical lens in the other direction, and a lens 208*b* which is a convex lens in the one direction and a cylindrical lens in the other direction. In this particular embodiment, the focal length of the lens 208*b* on the emitting side is shortened in comparison with the embodiment in FIGS. 25A and 25B.

More specifically, it is possible to change the relationship between the width d3 of the incident light and the width d4 of the emitted light by modifying the focal length of the lens 208*b* on the emitting side shown in FIGS. 29A and 29B. It is also possible to prepare a plurality of optical systems having different emission widths, as in FIGS. 25A and 25B and FIGS. 29A and 29B, in such a manner that parallel light of the required width can be obtained by switching between the optical systems.

Figure 30A:
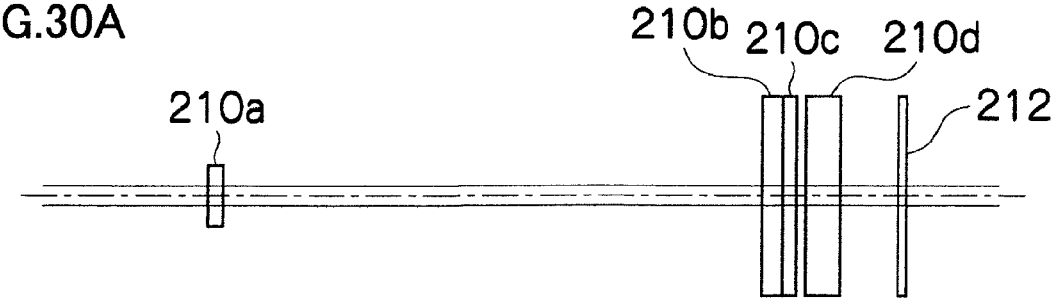
FIGS. 30A and 30B are a plan view and a side view, respectively, showing schematically a second embodiment of the optical system which alters a width of parallel light.
Figure 30B:
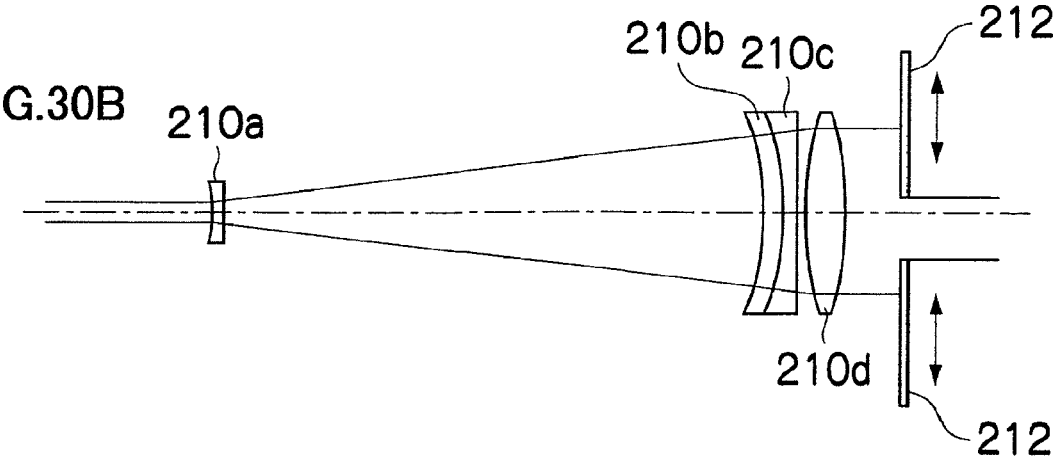

FIGS. 30A and 30B show a second embodiment of the composition of the optical system in which the width of the parallel light can be varied. In the second embodiment, a movable aperture device that varies the width of the parallel light is disposed on the emitting side. As shown in FIGS. 30A and 30B, the basic lens configuration in this embodiment is the same as that shown in FIGS. 15A and 15B, with the lens 210*a* on the incident side being a concave lens in one direction perpendicular to the optical axis and a cylindrical lens in the other direction, and the lens 210*d* on the emitting side being a convex lens in one direction perpendicular to the optical axis and a cylindrical lens in the other direction. Moreover, in this embodiment, a movable aperture device 212 for varying the width of the parallel light is disposed after the lens 210*d* on the emitting side. The aperture device 212 is driven as shown by the arrows in FIG. 30B, in such a manner that the width of the parallel light beam can be altered by adjusting the gap formed by the aperture device 212.

Moreover, in this embodiment, any aberration can be satisfactorily corrected by the combination of a plurality of lenses 210*b* and 210*c* with the emitting-side lens 210*d*. In this way, by using the optical system preventing aberration, a composition is achieved which is suitable for passing a parallel light beam through a relatively long distance, as is the case when determining ink droplets.

Figure 31A:
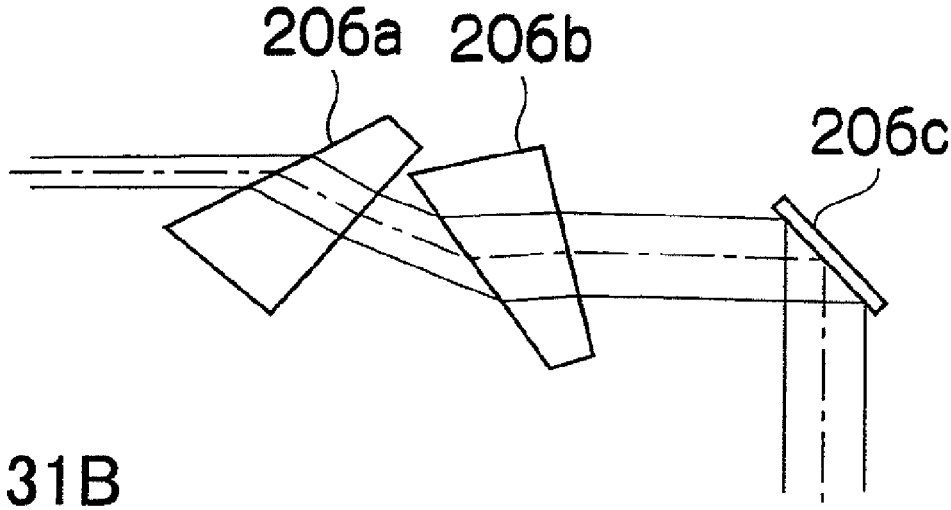
FIGS. 31A and 31B are a plan view and a side view, respectively, showing schematically a third embodiment of the optical system which alters a width of parallel light.
Figure 31B:
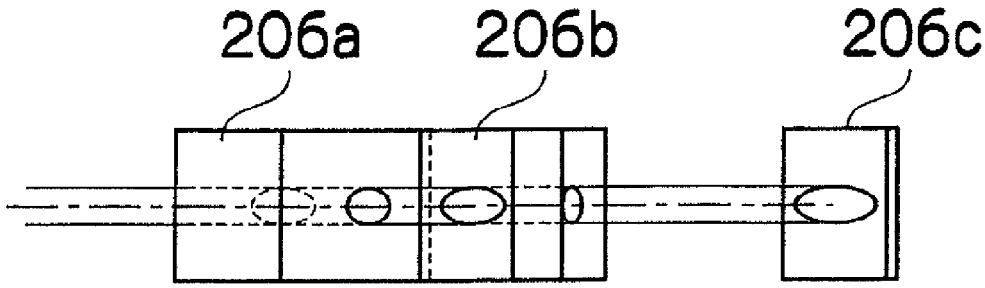

FIGS. 31A and 31B show a third embodiment of the composition of the optical system in which the width of the parallel light can be varied. This composition is similar to that in FIGS. 28A and 28B, which is designed in such a manner that the width of the parallel light is varied by changing the positional relationship between the prisms 206*a* and 206*b*.

Next, a beam forming device which can switch between a case where the cross-sectional shape of the parallel light is elongated in the direction of flight of the ink droplets and a case where the cross-sectional shape is elongated in a direction perpendicular to this direction of flight, will be described.

One method for switching the vertical and horizontal dimensions of the parallel light beam is a method which turns the optical system on the optical axis. More specifically, in the optical systems shown in FIG. 25A to FIG. 31B described above, since the effects on the incident parallel light are different in the two directions perpendicular to the optical axis, with the exception of the configurations shown in FIGS. 28A and 28B and FIGS. 31A and 31B, which use prisms, it is possible to switch from a parallel light beam having a long cross-section in the vertical direction to a parallel light beam having a long cross-section in the horizontal direction, by turning the optical system through 90° on the optical axis. Furthermore, in the case of FIGS. 28A and 28B or FIGS. 31A and 31B, it is possible to switch the widths of the parallel light in a similar fashion by turning the prism sections through 90° on the optical axis of the emitted light. In these cases, the modification device 100 shown in FIG. 9 includes a drive system which mechanically turns the constituent elements (the lenses or prisms) of the optical system 90.

Moreover, another possible method for switching the vertical and horizontal dimensions of the parallel light beam is a method in which two beam expanders for varying the width of the parallel light beam as shown in FIGS. 29A to 31B are used in a serial arrangement, in such a manner that the widths of the parallel light are changed independently and respectively in the two directions perpendicular to the optical axis.

FIGS. 27A and 27B show a composition in which two beam expanders are coupled in a serial arrangement, and by using two beam expanders such as those shown in FIGS. 28A to 31B in a serial arrangement of this kind so that the widths of the parallel light can be changed independently in the two directions perpendicular to the optical axis, it is possible to convert parallel light having a long cross-section in the vertical section into parallel light having a long cross-section in the horizontal section.

In this case, it is possible to continuously change the shape of the beam, by using an optical system capable of continuously changing the width of the parallel light in particular, such as a zoom lens or a pair of anamorphic prisms.

Further Embodiments

Figure 32:
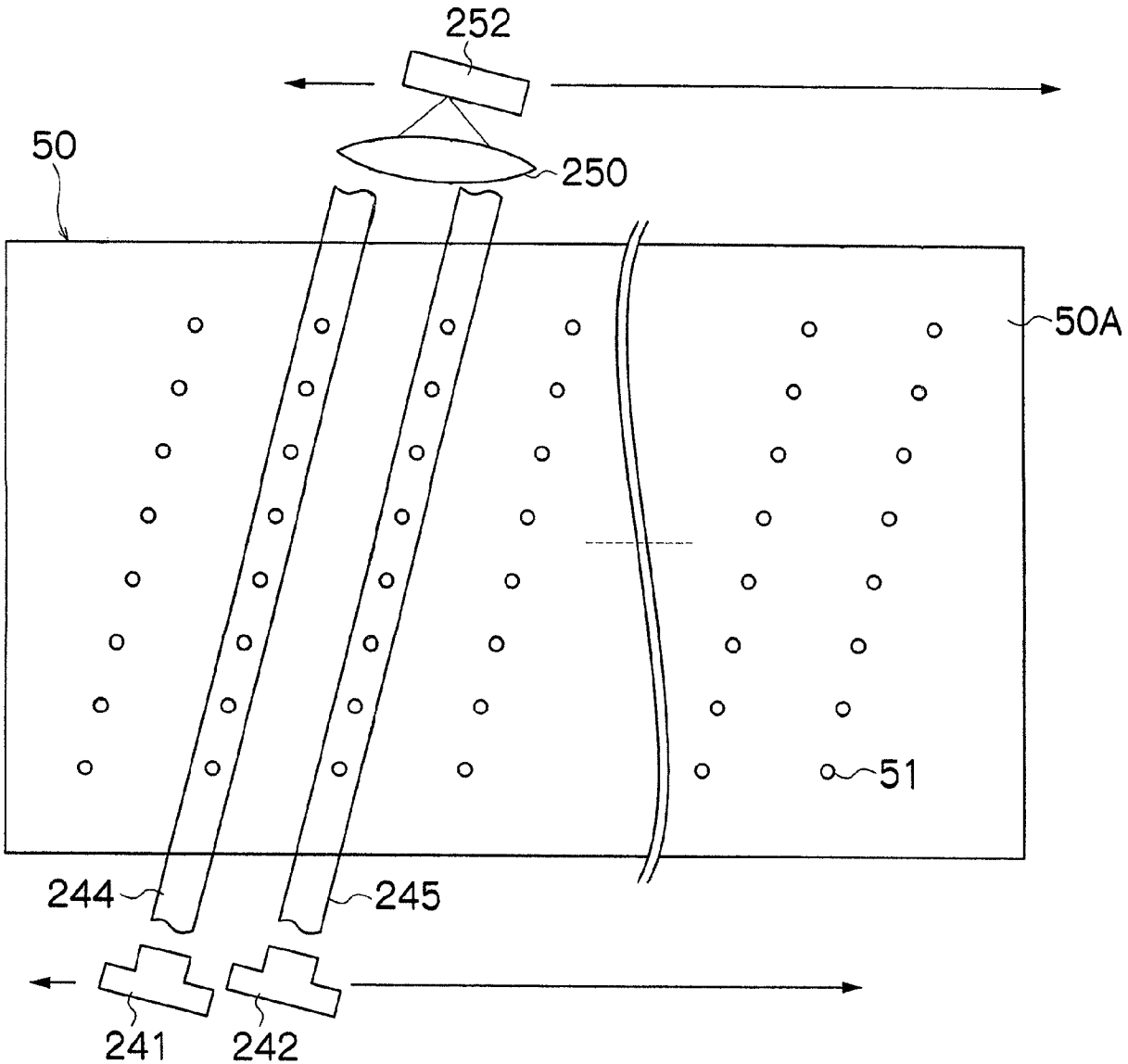
FIG. 32 is a schematic drawing of an ejection inspection apparatus according to another embodiment of the present invention.

FIG. 32 shows a further embodiment of the present invention. As shown in FIG. 32, a mode is also possible in which a plurality of determination light beams 244 and 245 are generated using a plurality of light sources 241 and 242, and ejection determination is performed by using the plurality of determination light beams 244 and 245 simultaneously. In this case, it is possible to adopt a composition in which a common condensing lens 250 is used for the plurality of determination light beams 244 and 245 in the light receiving system, and the light is directed onto a photosensor 252 of a smaller number (in FIG. 32, one photosensor) than the number of the light sources. In FIG. 32, two light sources 241 and 242 are depicted; however, a greater number of light sources can be used.

According to this composition, it is possible to simultaneously determine the ejection state of a greater number of nozzles 51, and hence the determination duration can be shortened yet further.

Figure 33:
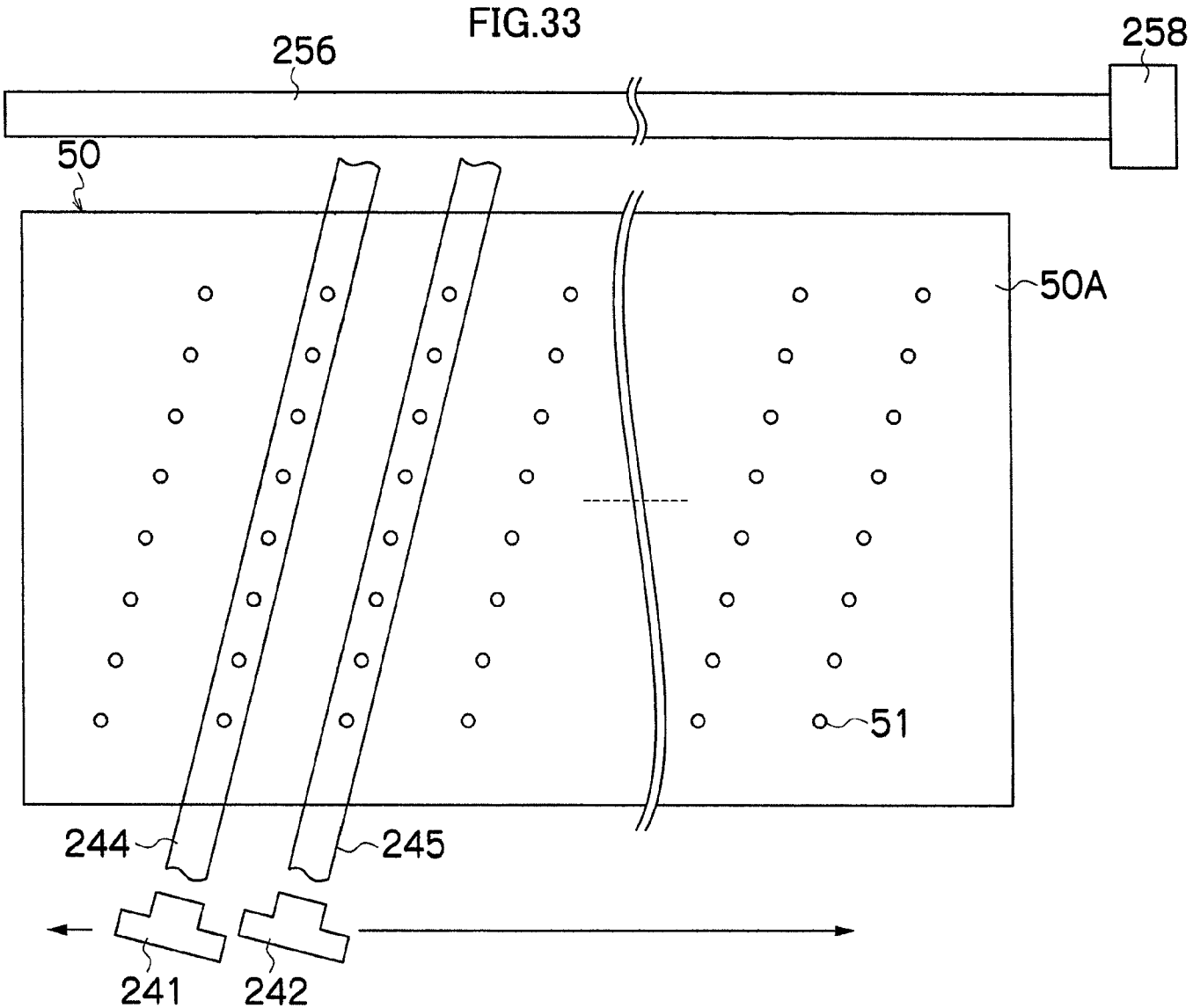
FIG. 33 is a schematic drawing of an ejection inspection apparatus according to a further embodiment of the present invention.

Furthermore, as shown in FIG. 33, it is also possible to adopt a composition in which a light path 256 is disposed on the light receiving side, and a photosensor 258 is disposed in an end of the light path 256. The determination light beams 244 and 245 irradiated from the light sources 241 and 242 are received via the light path 256, in such a manner that they are directed to the photosensor 258 by passing along the light path 256.

In the case of this composition also, it is possible to set the number of photosensors to a smaller number than the number of light sources. Furthermore, in the composition in FIG. 33, no movement mechanism is required for the light receiving system, and it is also possible to move the plurality of light sources 241 and 242 independently.

In the foregoing explanations, the inkjet recording apparatus 10 has been described; however, the scope of application of the present invention is not limited to this. For example, the liquid ejection apparatus according to the present invention may also be applied to a photographic image forming apparatus having a liquid ejection head which applies developing solution, or the like, onto a printing paper by means of a non-contact method. Furthermore, the scope of application of the present invention is not limited to an image forming apparatus, and the present invention may also be applied to various other types of apparatuses which spray a processing liquid, or other liquid, toward an ejection receiving medium by means of a liquid ejection head (such as a painting device, a coating device, a wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head having a plurality of ejection ports which eject droplets of liquid;

a light emitting device which emits a determination light beam intersecting with flight paths of the droplets ejected from at least two of the ejection ports to be examined;

a light receiving device which receives the determination light beam having passed through the flight paths of the droplets and outputs a determination signal corresponding to an amount of received light;

a first ejection port selection device which selects the at least two of the ejection ports to be examined with respect to ejection failure so that a distance between the at least two of the ejection ports selected by the first ejection port selection device along the optical axis of the determination light beam is larger than a prescribed specific distance;

a first ejection control device which performs ejection driving to eject the droplets at substantially same time from the at least two ejection ports selected by the first ejection port selection device;

a first ejection state judgment device which judges whether or not the droplets are ejected from the at least two ejection ports to be examined with respect to ejection failure according to the determination signal outputted by the light receiving device when the droplets ejected due to the ejection driving performed by the first ejection control device pass through the determination light beam;

a second ejection port selection device which selects the at least two of the ejection ports to be examined with respect to flight abnormality so that the at least two of the ejection ports are disposed on a line parallel to the optical axis of the determination light beam, and that a distance between the at least two of the ejection ports selected by the second ejection port selection device along the optical axis of the determination light beam is smaller than the prescribed specific distance;

a second ejection control device which performs ejection driving to eject the droplets at substantially same time from the at least two ejection ports selected by the second ejection port selection device; and a second ejection state judgment device which judges a presence of an abnormality in at least one of a flight direction and a flight speed of the droplets ejected from the ejection ports to be examined with respect to flight abnormality according to the determination signal outputted by the light receiving device when the droplets ejected due to the ejection driving performed by the second ejection control device pass through the determination light beam.

2. An image forming apparatus comprising the liquid ejection apparatus as defined in claim 1, which forms an image on a recording medium by means of the droplets ejected from the ejection ports.

* * * * *